US006463967B1

(12) United States Patent
Boyle

(10) Patent No.: US 6,463,967 B1
(45) Date of Patent: Oct. 15, 2002

(54) SYSTEM FOR DIAGNOSING, MAINTAINING AND REPORTING THE PERFORMANCE AND SAFETY CONDITION OF APPARATUS DURING REFUELING

(75) Inventor: Frederick P. Boyle, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/715,519

(22) Filed: Nov. 17, 2000

(51) Int. Cl.[7] ..... B65B 1/30; B65B 31/00; B67C 3/02

(52) U.S. Cl. ..... 141/94; 141/83; 141/99; 141/100; 141/104

(58) Field of Search ..... 141/83, 94, 99, 141/100, 104, 285, 302, 389, 393; 702/45, 47, 51, 55

(56) References Cited

U.S. PATENT DOCUMENTS 5,913,180 A * 6/1999 Ryan ..... 235/375
5,923,572 A * 7/1999 Pollock ..... 141/94

* cited by examiner

*Primary Examiner*—Timothy L. Maust
(74) *Attorney, Agent, or Firm*—Teresan W. Gilbert; Michael F. Esposito

(57) ABSTRACT

A system for automatically and simultaneously diagnosing apparatus performance and safety condition, maintaining on-apparatus components and sub-systems, and reporting apparatus condition and maintenance action taken during apparatus refueling. Diagnostic sub-systems include means for determining the condition of fluids or components that are consumed or deteriorate during use. Maintenance sub-systems include means for replacing, replenishing or renewing non-fuel fluids or components that are consumed or deteriorate during use. Reporting sub-systems include means for communicating information between on- and off-apparatus sub-systems and for generating reports that document apparatus performance and safety condition and the maintenance actions taken during refueling. A report can be presented to the apparatus operator, apparatus maintenance technician and/or to a central reporting facility. The report can be used to identify existing or potential apparatus system/sub-system or component failure, to schedule needed repair, to certify regulatory compliance, to optimize the performance of the apparatus, apparatus sub-system or operator, or to manage the cost of apparatus operation.

64 Claims, 17 Drawing Sheets

SYSTEM FOR DIAGNOSING, MAINTAINING AND REPORTING THE PERFORMANCE AND SAFETY CONDITION OF APPARATUS DURING REFUELING

FIELD OF THE INVENTION

The present invention relates to a system for automatically diagnosing, maintaining and reporting the performance and safety condition of various industrial and transportation devices such as remote power generation or pumping equipment and on- or off-highway vehicles and the like (hereinafter collectively referred to as "apparatus"). More specifically, this invention relates to a cost effective system for diagnosing and maintaining apparatus fluids and components that are lost, consumed or deteriorate during apparatus use, and for documenting and reporting present apparatus condition and maintenance performed in a manner that can allow failed or failing apparatus systems or components to be identified and repairs to be scheduled, that can certify the apparatus' regulatory compliance, that can allow apparatus, apparatus sub-system, or apparatus operator performance to be optimized, or that can allow managing the cost of apparatus operation.

BACKGROUND OF THE INVENTION

Periodic inspections and maintenance is essential for the proper operation and long service life of various apparatus. Inspections can include for example monitoring fluid levels such as engine oil, gear oils, chassis lubricant, coolant, windshield washer, brake and tire-air, as well as monitoring wear components such as brakes and tires, and monitoring other components such as filters and lights that deteriorate or fail due to age or use. Maintenance can include replenishment of consumed or lost fluids, replacement of used fluids, and renewal of items such as cleaning fluid filters for improved apparatus performance and/or longer apparatus life. As used herein, "fluid(s)" or "maintenance fluid(s)" means any non-fuel fluid that can flow through a conduit including liquids, gases, semi-solids, electric current and fine particulates. Examples of liquids are engine oil, grease lubricant, metalworking fluid, hydraulic fluid, coolant, transmission fluid, brake fluid, and cleaning fluid. Examples of gases are air, nitrogen, oxygen, carbon dioxide and refrigerant. Examples of semi-solids are greases. Examples of fine particles are abrasives.

These periodic inspection and maintenance requirements are considered by most to be, at the very least, an inconvenience, and more typically, an unwanted burden of apparatus operation or ownership that add significantly to operating costs. Costs incurred are both direct, (e.g., labor, records keeping and materials, including any waste disposal, of the inspection and maintenance process) and indirect (e.g., lost productivity while the apparatus is being inspected and maintained). In addition to being an unwanted burden to the apparatus owner or operator, many maintenance items, especially those associated with fluids maintenance, can be an environmental burden if the owner or operator does not properly dispose of the used fluids and other maintenance items.

A variety of methods and systems have been disclosed that attempt to minimize the fluid inspection and maintenance burden. One approach is to simply provide the apparatus operator or maintenance provider with a better diagnosis of when maintenance or inspection is required. For transportation apparatus, U.S. Pat. No. 4,847,768, Schwartz et al., July 1989, discloses a system and method for indicating the remaining useful life of engine oil during engine operation based on engine operating parameters. U.S. Pat. No. 5,819,201, DeGraaf, October 1998, discloses a navigation system that displays service reminders at user-defined intervals, and directions to a vehicle service location. A limitation of simply providing information as to when to perform the maintenance or inspection is that this alone does little to relieve the burden of actually performing the maintenance or inspection.

Another approach to minimizing the fluid inspection and maintenance burden is the use of off-apparatus methods and systems to reduce the time or the inconvenience of the fluid inspection and maintenance operations.

For transportation apparatus, U.S. Pat. No. 3,866,624, Peterson, February 1975, discloses a gasoline service lane for a gas station with a recessed service pit that allows a service technician to perform work under the vehicle while the vehicle is being refueled. U.S. Pat. No. 5,787,372, Edward et al., July 1998, discloses an automated system for evacuating used fluid from a fluid receptacle, such as the oil sump of an internal combustion engine, and replenishing with fresh fluid. U.S. Pat. No. 5,885,940, Sumimoto, March 1999, discloses a method for total or partial exchange of lubricant oil when a vehicle stops at a gas station for refueling. Stand-alone quick oil-change facilities also fall into this category of off-apparatus methods and systems. Known art in this off-apparatus approach, in general, reduces the time and, in some cases, the inconvenience of apparatus maintenance and/or inspection. These off-apparatus service methods and systems, however, do not remove the operator or service technician burden of scheduling time for when the maintenance or inspection is to be performed. Nor do they provide a convenient means of tracking and recording the service details for individual apparatus that have service performed at a multitude of locations during the apparatus' operational life.

Another approach to minimizing the inspection and maintenance burden is the use of on-apparatus methods and systems. U.S. Pat. No. 4,967,882, Meuer et al., November 1990, discloses a central lubricating installation that automatically lubricates components at regular intervals and varies the pumping time per each grease application based on the starting current of the pump motor. For transportation apparatus, U.S. Pat. No. 5,749,339, Graham et al., May 1998, discloses an on-apparatus method and system for automatically replacing an engine's used lubricating oil with fresh oil during engine operation based on operating conditions. U.S. Pat. No. 5,964,318, Boyle et al., October 1999, discloses a system and method for sensing the quality of an engine's lubrication oil to diagnose potential engine failure and to automatically replace used oil with fresh oil to maintain oil quality.

In addition, commercial systems are available that provide real-time on-vehicle inspection of tire pressure, brake wear, lighting failure and others to alert the operator or a service technician when service or repair is needed. While on-apparatus approaches potentially offer the best solution to fluid maintenance and inspection burdens, these systems also create other ownership burdens. On-apparatus systems have relatively high cost and, particularly those that maintain fluids, can have large space requirements for reservoirs, pumps and other needed equipment. This creates the burden of substantially higher apparatus cost, which may be acceptable for mission critical or high-value equipment or apparatus, but is unacceptable or not practical for many apparatus. In addition, for on-apparatus fluids maintenance systems, maintenance is not fully eliminated, since the operator or service technician must still fill fresh fluid reservoirs and, in some cases, empty used fluid reservoirs on a regular basis.

Another limitation of on-board systems used with mobile equipment or apparatus is that timely reporting of the system's outputs or actions requires a costly remote communication system that downloads the information, or requires the inconvenience of the apparatus frequently connecting to specialized equipment that communicates with the systems. A timely download of the information is particularly important for apparatus serviced by a central maintenance function that optimizes apparatus performance through analysis of performance, safety and maintenance data.

Another approach to minimizing the fluid inspection and maintenance burden that reduces the cost and space requirements of on-apparatus solutions is the use of on-apparatus/off-apparatus methods and systems. This approach places most of the costly and bulky maintenance and inspection equipment in a central location that services a multitude of apparatus, and places only apparatus-specific maintenance and inspection equipment on the individual apparatus. For transportation apparatus, U.S. Pat. No. 3,621,938, Beattie, November 1971, discloses a lubricating system for applying grease to apparatus using an off-apparatus pump and reservoir that connects at a single point to an on-apparatus network that distributes the grease to individual components. The Beattie invention, however, does not determine the precise amount of grease to apply to individual apparatus, nor does the system record how much grease is applied.

Further for transportation apparatus, U.S. Pat. No. 2,966,248, Armbruster, December 1960, discloses a system with an on-apparatus general supply port that allows the apparatus operator, in one operation, to purchase fuel and engine oil and to receive other maintenance fluids such as air, water, distilled water, and grease for free. This system also provides for charging the apparatus' battery during fluid purchase, and automatically photographing the apparatus' license numbers to record apparatus use of the system. While this system provides the convenience of replenishing apparatus fluids in one location, the system does not allow for diagnosing fluid quality, maintaining fluid quality by exchanging fresh for used fluids, diagnosing the apparatus' performance or safety condition, renewing fluid filters, and documenting and reporting the actual maintenance provided.

The known prior art does not provide a complete, cost-effective system for diagnosing and maintaining a wide range of fluid/apparatus performance and safety issues, and for documenting and reporting current fluid/apparatus performance condition and maintenance actions performed in a timely manner. The known prior art has not changed the current maintenance paradigm in a manner that significantly reduces the overall apparatus ownership inconvenience and burden.

SUMMARY OF THE INVENTION

The present invention relates to a cost-effective system that allows apparatus maintenance and inspection operations and apparatus information transfer to occur automatically and simultaneously, with little additional effort or time, during apparatus refueling to reduce the inconvenience and burden of apparatus ownership.

One feature of the invention is to document the apparatus maintenance and inspection and to report the apparatus' current performance and safety condition and the maintenance performed during refueling.

Another feature of the invention is that the apparatus diagnostics, maintenance and reporting functions can be tailored to the needs of an individual apparatus, or of an apparatus owner or operator.

Another feature of the invention is that only those on-apparatus components/sub-systems that can be cost justified are used, based on a real-time operator or service-provider need-to-know, or that are apparatus specific for sensing and/or for communicating information or fluids.

Another feature of the invention is that the majority of the costly, bulky, or fluid containing components/sub-systems for apparatus diagnosis, maintenance and reporting are located at a fuel service location for use by a multitude of apparatus to reduce per-apparatus cost.

Another feature of the invention is that the off-apparatus components/sub-systems can be placed in a controlled, less harsh, operating environment with easier serviceability than if the components/sub-systems were mounted on the apparatus.

Another feature of the invention is that off-apparatus maintenance sub-systems can replenish or replace apparatus fluids during refueling to maintain the quality or level of the fluids.

Another feature of the invention is that the fluid maintenance system can renew contaminant removal components, such as filters, by backflushing either with used non-fuel fluids as they are removed during the maintenance operation, or with specific cleaning or renewing fluids to maintain the operation of the contaminant removal components.

Another feature of the invention is that the maintenance system can renew the apparatus' exterior finish and appearance by spraying the apparatus with cleaning and/or protective fluid(s).

Another feature of the invention is that all fluids maintained or used in accordance with the invention are handled at the fuel service location where proper fluid handling practices are already in place for fluids that have potential hazard for the environment.

Another feature of the invention is that apparatus performance or safety condition diagnosis can be based on downloaded on-apparatus sensors or systems output, can be determined by off-apparatus sensors or systems, or can be determined based on algorithms that use a variety of on- and/or off-apparatus inputs.

Another feature of the invention is that the same information communication means, used to communicate apparatus performance, safety and maintenance information, can be used to download additional information from or upload additional information to the apparatus including for example apparatus content, logistics, driver performance and personal communications.

Another feature of the invention is that, while desirable for apparatus with on-apparatus maintenance or inspection sub-systems to always use a fuel service location with off-apparatus sub-systems of the invention, when necessary, and if properly equipped, the apparatus can, if necessary, use fuel service locations that do not have the off-apparatus sub-systems.

Another feature of the invention is that, when refueling is completed, the apparatus operator or fuel service location technician can be given a report detailing complete performance and safety condition of the apparatus.

Another feature of the invention is that, when refueling is completed, the apparatus operator or fuel service location technician can be given a report detailing only those issues that require immediate attention, or containing information showing the apparatus' regulatory compliance.

Another feature of the invention is that reports detailing the performance and safety condition of the apparatus and the maintenance performed during refueling can be used in a variety of ways, for example:

- To alert a service provider to schedule repair/maintenance that is not provided at the fuel service location. p1 To provide data to a service provider for optimizing apparatus, apparatus sub-system or operator performance.
- To provide manufacturers a maintenance history of items returned for warranty repair or replacement.
- To provide manufacturer real-world performance and maintenance information for optimizing apparatus or apparatus sub-system design and manufacture.
- To allow complete analysis of the cost of apparatus operation.
- To allow information to be uploaded to the apparatus as either a temporary or permanent record of the apparatus' performance and safety condition and maintenance history.
- To alert a regulatory enforcement agency if the apparatus is out of compliance.

The foregoing and other aspects and features of the invention will become apparent from the following description made with reference to the drawings.

DETAILED DESCRIPTION OF THE INVENTION

The invention relates to a system for automatically and simultaneously diagnosing apparatus performance and/or safety condition, maintaining on-apparatus components and/or sub-systems, and reporting apparatus condition and/or maintenance action taken during apparatus refueling. This includes maintaining the quality and/or level of any fluid(s) that are consumed, lost or used in an apparatus thereby maintaining the performance and/or extending the life of such apparatus. In general, any apparatus that is periodically refueled and consumes, loses or uses non-fuel fluids can have such fluids maintained by the systems of the invention. The invention performs these automatic and simultaneous actions in a manner that requires little additional effort and time for the apparatus operator or maintenance technician when compared to the traditional refueling process.

The fluid of an apparatus component may be maintained by replenishing or replacing the component fluid with a maintenance fluid that is essentially the same as the component fluid or is specially formulated to renew the component fluid. For example, the maintenance fluid may have at least one additive that improves the fluid performance of the component fluid. Examples of such performance additives are a corrosion inhibitor, viscosity modifier, dispersant, friction modifier, coolant inhibitor, surfactant, detergent, and extreme pressure agent.

As used herein, refueling means not only the replenishment of a liquid or gas that is combusted in an internal combustion engine as described herein, but also the process of replacing or replenishing any energy source of apparatus including either transportation devices or machinery such as industrial equipment or the like. For an electric powered apparatus, for example, refueling is the recharging or replacement of the batteries, capacitors, gel cells and the like that store the electrical energy used to drive the electric motor(s). For a fuel-cell powered electric vehicle, refueling is the replenishment of the liquid or gas that is converted into electricity, and so on.

For purposes of illustration, the following embodiments are shown and described.

Figures 1, 2:
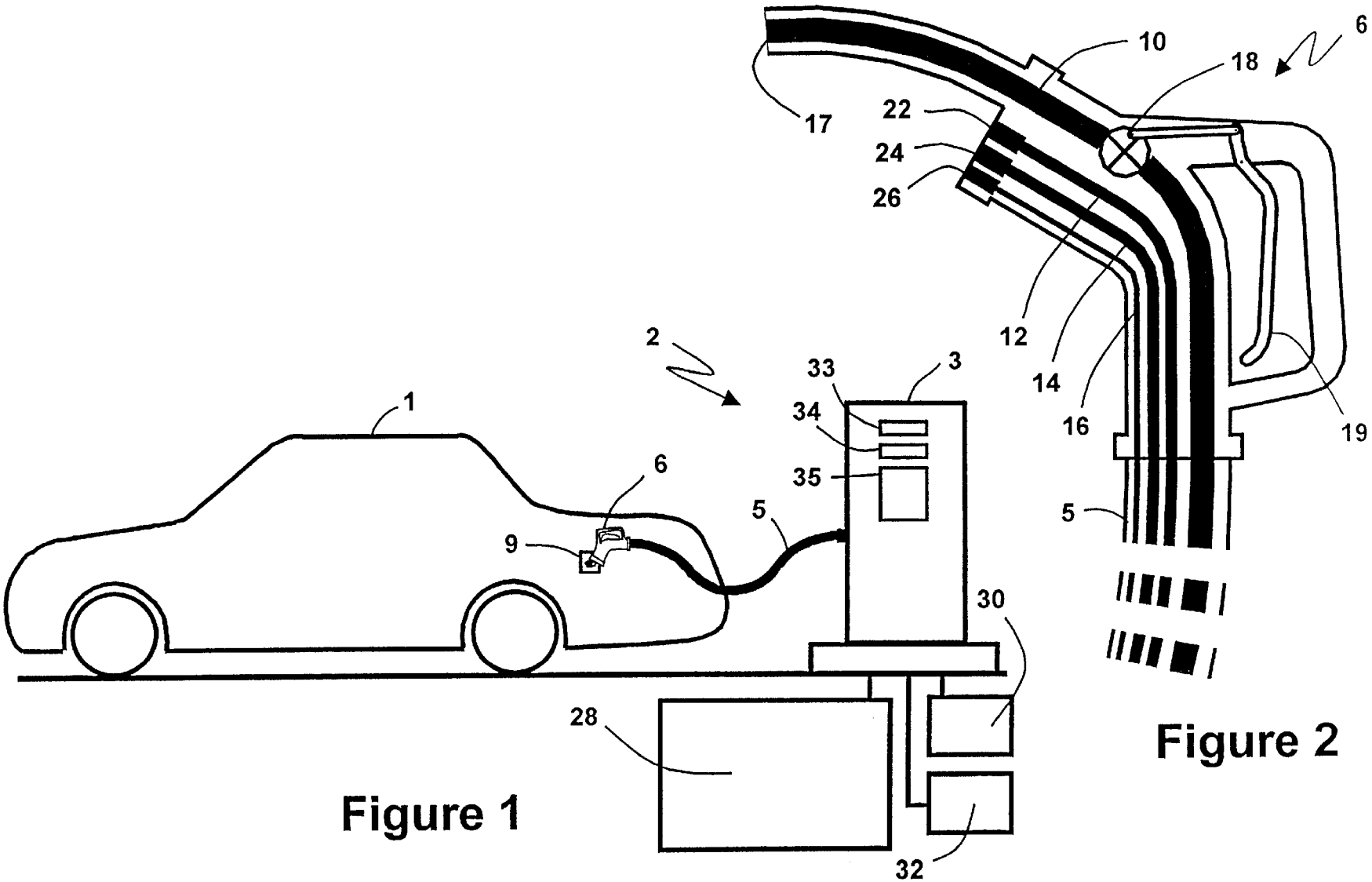
FIG. 1 is a schematic illustration of one embodiment of the present invention including a fuel service location with a single dispenser and single hose having a nozzle for providing fluid communication between a plurality of off-apparatus fluid reservoirs and a port of an apparatus.
FIG. 2 is an enlarged schematic cross-section view of the fuel service location nozzle assembly of FIG. 1.

FIG. 1 shows one embodiment of the invention where transportation apparatus 1 such as a passenger vehicle or heavy-duty highway truck is refueling at fuel service location 2 with dispenser 3. Dispenser 3 has a hose 5 for communicating fluids and information between the dispenser and a nozzle 6 which mates with a connector port 9 on the apparatus 1. Traditionally, nozzle 6 and port 9 are designed to transfer only fuel from dispenser 3 to the fuel tank (not shown) of apparatus 1 during the refueling process, whereby hose 5 usually has either only one conduit for the communication of fuel or two conduits for fuel communication and vapor recovery. However, as shown in FIG. 2, in this invention embodiment, nozzle 6 and hose assembly 5 have a multitude of conduits, for example, four conduits 10, 12, 14, 16 for communicating fuel as well as non-fuel fluids and information between dispenser 3 and port 9 of apparatus 1.

Conduit 10 with outlet 17 and valve assembly 18 actuated by nozzle lever 19 communicate fuel from dispenser 3 to port 9 on apparatus 1. In this embodiment, the shape and length of outlet 17 is designed to allow nozzle 6 to be used with all apparatus, including those without the on-apparatus maintenance sub-systems of this invention for refueling. Conduits 12, 14, 16 terminate at connectors 22, 24, 26 respectively. Other conduits (not shown), if provided, similarly terminate at other connectors (not shown). Connectors 22, 24, 26 are normally closed unless mated to corresponding connectors on the apparatus 1, and are designed and positioned on nozzle 6 such that nozzle 6 can enter port 9 of apparatus 1 in only one orientation to assure proper mating between connectors 22, 24, 26 and appropriate connectors at port 9.

It should be noted that apparatus 1 can have a fewer number of connectors than nozzle 6 if the apparatus does not have or require all of the on-apparatus maintenance subsystems that nozzle 6 is capable of supplying. In any case, nozzle 6 mates to port 9 in a manner to assure that appropriate fluids will flow from dispenser 3 to apparatus 1 or from apparatus 1 to dispenser 3 through the respective conduits in both apparatus 1 and nozzle 6/hose assembly 5. Similarly, one or more of the conduits in nozzle 6 and hose assembly 5 can be information conduits that allow either communication of electrical, optical, magnetic or acoustical information between apparatus 1 and dispenser 3.

Referring further to FIG. 1, during refueling of apparatus 1, dispenser 3 uses pumps, meters and electronics (not shown) to communicate fluids either to or from apparatus 1 in a manner that determines and maintains desired performance and safety of components and sub-systems and allows reporting of apparatus condition and maintenance performed during refueling. Fuel service location 2 has a multitude of fluid reservoirs 28, 30, 32 (three of which are shown by way of example) for either storing maintenance fluids that can be pumped to the apparatus or for receiving used fluids that can be pumped from the apparatus 1 during refueling and maintenance operations. For example, reservoir 28 may contain fuel, reservoir 30 may contain maintenance engine oil fluid and reservoir 32 may be for storing used engine oil.

Dispenser 3 may include displays 33 and 34 and printer 35. Display 33 shows, for example, the volumes of fluids replenished, replaced or otherwise consumed during maintenance of apparatus 1; display 34 shows, for example, the total cost of apparatus maintenance (including the cost of the fuel); and printer 35 provides, at the end of refueling, a report of appropriate maintenance information. Maintenance information can include one or more of the following: maintenance date, maintenance location, maintenance cost, fluid condition input(s), apparatus use input(s), apparatus condition input(s), determined or diagnosed fluid or apparatus condition(s) based on inputted or sensed inputs, fluid volume and type communicated during maintenance (including fuel volume and type), or any additional inputs received by the control means during apparatus maintenance at the fuel service location. In the case where maintenance information includes determined or diagnosed fluid or apparatus condition(s), a maintenance information report from printer 35 can, if the fluid or apparatus is within performance, safety or regulatory specification, include certification(s) or compliance, or can, if the fluid or apparatus is not within performance, safety or regulatory specification, include warning(s) of the determined or diagnosed condition(s). In addition, dispenser 3 may include suitable communication means (not shown) for sending appropriate maintenance information reports to any desired number of organizations or individuals for use or analysis of the information.

In the invention embodiment shown in FIG. 1, only one hose 5 is provided between a single dispenser 3 and apparatus 1 to minimize the time and effort of system use. Other embodiments of the invention, however, may have two or more hoses between one or more dispensers at the fuel service location, as long as the dispensers communicate in a manner that allows for automatic and simultaneous diagnosis, maintenance and reporting during refueling.

Figure 3:
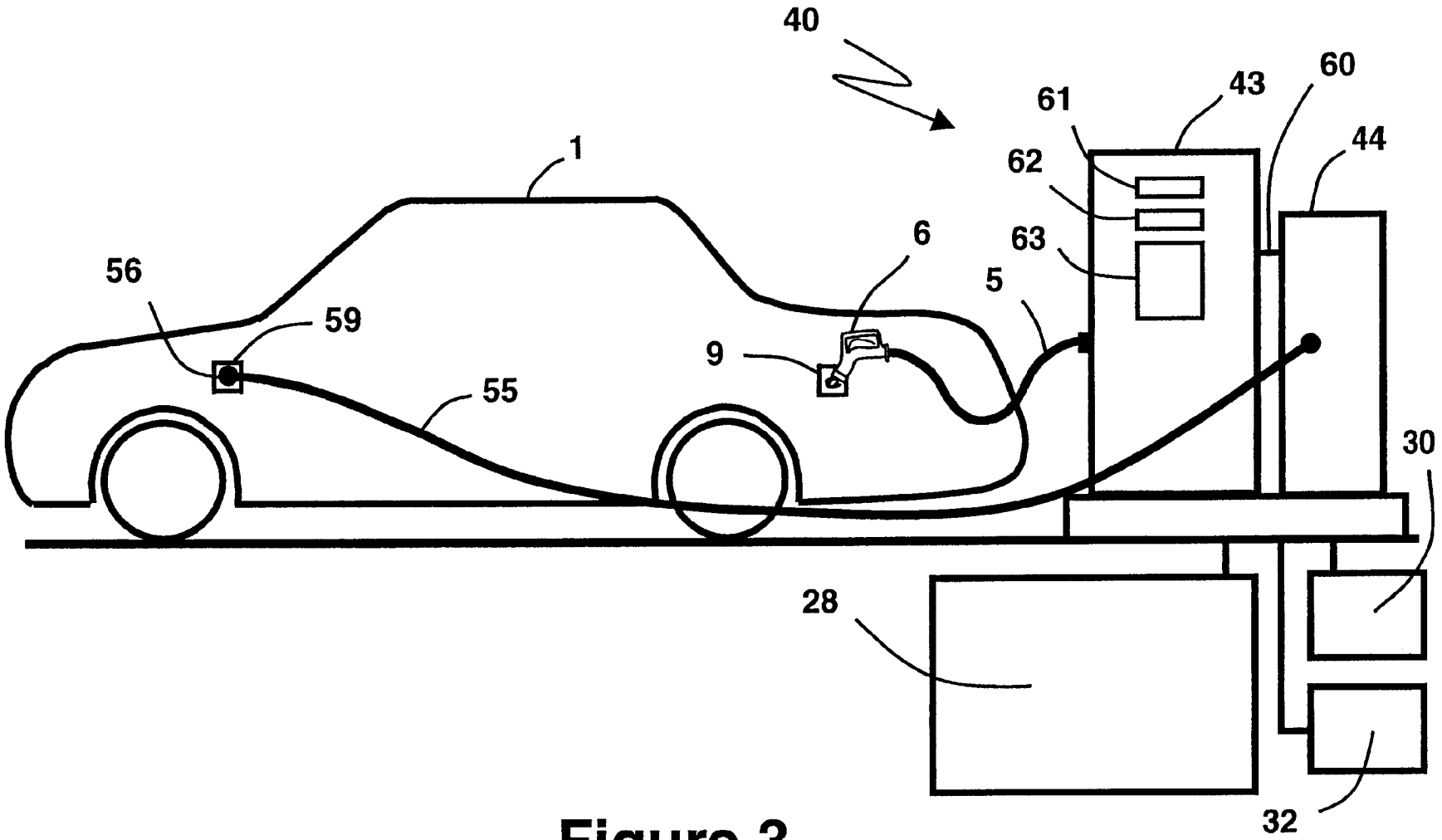
FIG. 3 is a schematic illustration of another invention embodiment including a fuel service location with multiple dispensers and multiple hoses each having nozzles for communicating with multiple ports of an apparatus.

FIG. 3 shows another invention embodiment where transportation apparatus 1 is refueling at fuel service location 40 including a fuel dispenser 43 and maintenance fluids dispenser 44. Dispenser 43 has hose 5 with nozzle 6 for communicating fuel to connector port 9 on apparatus 1, and can be used alone to pump fuel from fuel reservoir 28 into any apparatus in the conventional manner. Dispenser 44 has a plurality of fluid reservoirs 30, 32 (two of which are shown by way of example) and hose 55 with multi-conduit connector 56 that connects to apparatus 1 at another port 59. Hose 55 includes a multitude of conduits (similar to conduits 12, 14, 16 shown in FIG. 2) for communicating fluids and possibly electrical, optical, magnetic or acoustic information between dispenser 44 and apparatus 1.

Connector 56 mates with port 59 in a manner that assures proper connection between conduits in hose 55 and appropriate conduits in apparatus 1 (not shown). Using suitable pumps, meters and electronics (not shown), dispenser 44 can communicate maintenance fluids to or used fluids from apparatus 1 in such a manner as to diagnose and maintain desired performance and safety of components and subsystems and allow reporting of apparatus condition and maintenance performed other than refueling.

Dispensers 43 and 44 communicate information through information conduit 60 that allows the diagnosis and maintenance operation to occur automatically and simultaneously during refueling. Also the information transferred by conduit 60 between dispensers 43 and 44 allows displays 61, 62 on dispenser 43 to show, for example, the volumes of fluids communicated and the total cost of apparatus refueling and maintenance, and allows printer 63 to provide an appropriate report of maintenance information. In addition, dispenser 43 may include communication means (not shown) for sending appropriate maintenance information reports to any number of organizations or individuals for use or analysis of the information.

Figure 4:
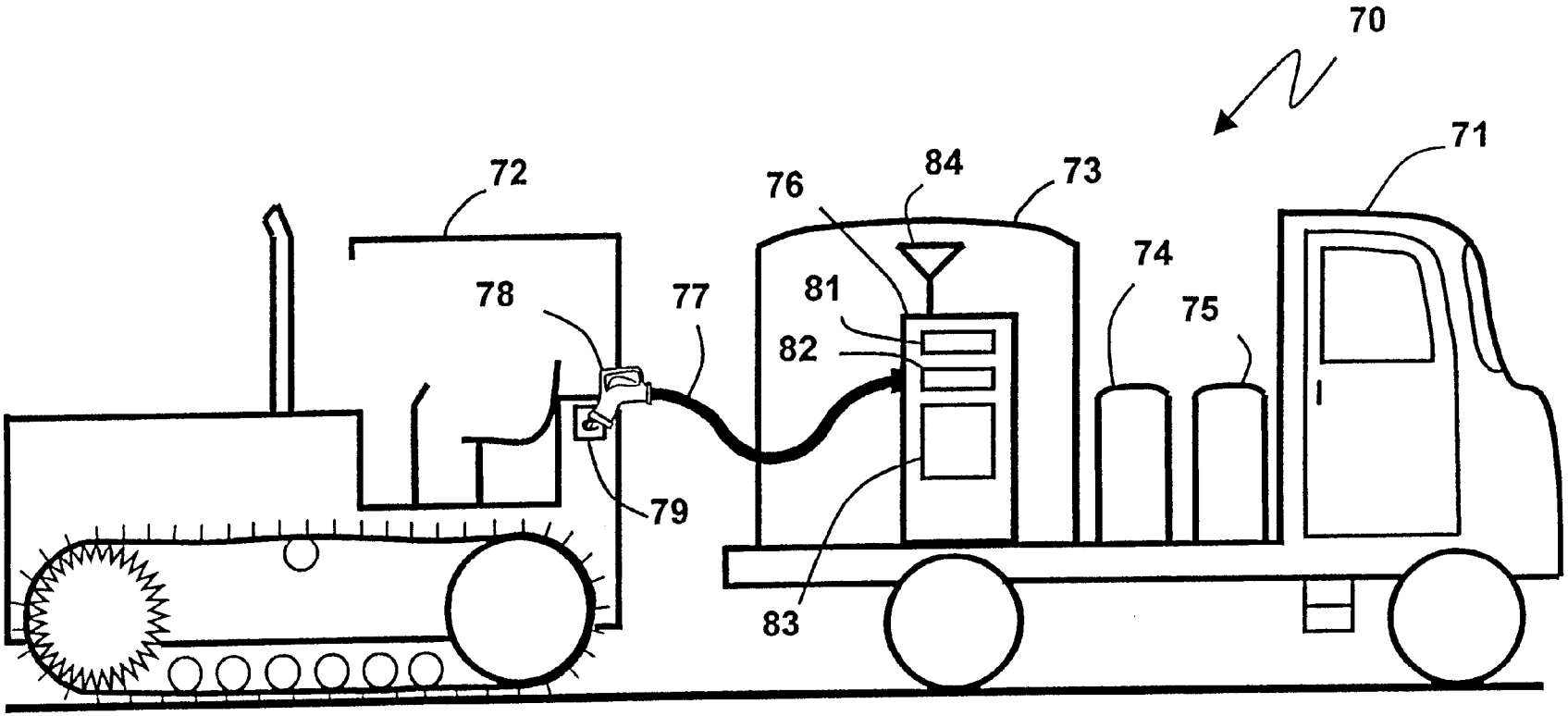
FIG. 4 is a schematic illustration of another invention embodiment in which the dispenser and associated reservoirs are mobile (e.g., mounted on a service/fuel truck) so they can be brought to the apparatus for fluid maintenance.

FIGS. 1 and 3 show embodiments with fixed fuel service locations to which transportation apparatus are driven for maintenance and diagnosis. The system of the present invention, however, does not require that apparatus be brought to a fixed fuel service location. FIG. 4, for example, shows an invention embodiment where the fuel service location 70 is mounted on truck 71 to make it mobile so it can be transported to an off-highway apparatus 72 or other apparatus, and includes a multitude of fluid reservoirs 73, 74, 75 and dispenser 76. Dispenser 76 has hose 77 for communicating fluid and information between the dispenser and nozzle 78 which mates with port 79 on apparatus 72, As in the FIG. 1 embodiment, hose 77 and nozzle 78 are designed to communicate a multitude of fluids between apparatus 72 and dispenser 76. Nozzle 78 is designed to mate with apparatus port 79 only in a manner that allows communication between conduits in hose 77 and appropriate conduits in apparatus 72. During refueling of apparatus 72, dispenser 76 uses pumps, meters and electronics (not shown) to communicate fluids between fuel service location 70 and apparatus 72 in a manner that diagnoses and maintains desired performance and safety of the components and sub-systems and that also reports apparatus condition and maintenance performed.

Dispenser 76 includes displays 81 and 82 that show volumes of fluids communicated and, if desired, total cost of apparatus refueling and maintenance. Also dispenser 76 includes a printer 83 to provide an appropriate maintenance information report to the apparatus operator or service technician. In addition, dispenser 76 may include communication means, for example radio frequency communication means with antenna 84, for real time transmission of appropriate report(s) from the mobile fuel service location to any number of organizations or individuals for use or analysis of the information. Alternatively, dispenser 76 may include communication means (not shown) to download report(s) by non-remote methods at intermittent intervals when connected to appropriate apparatus sub-systems.

Figure 5A:
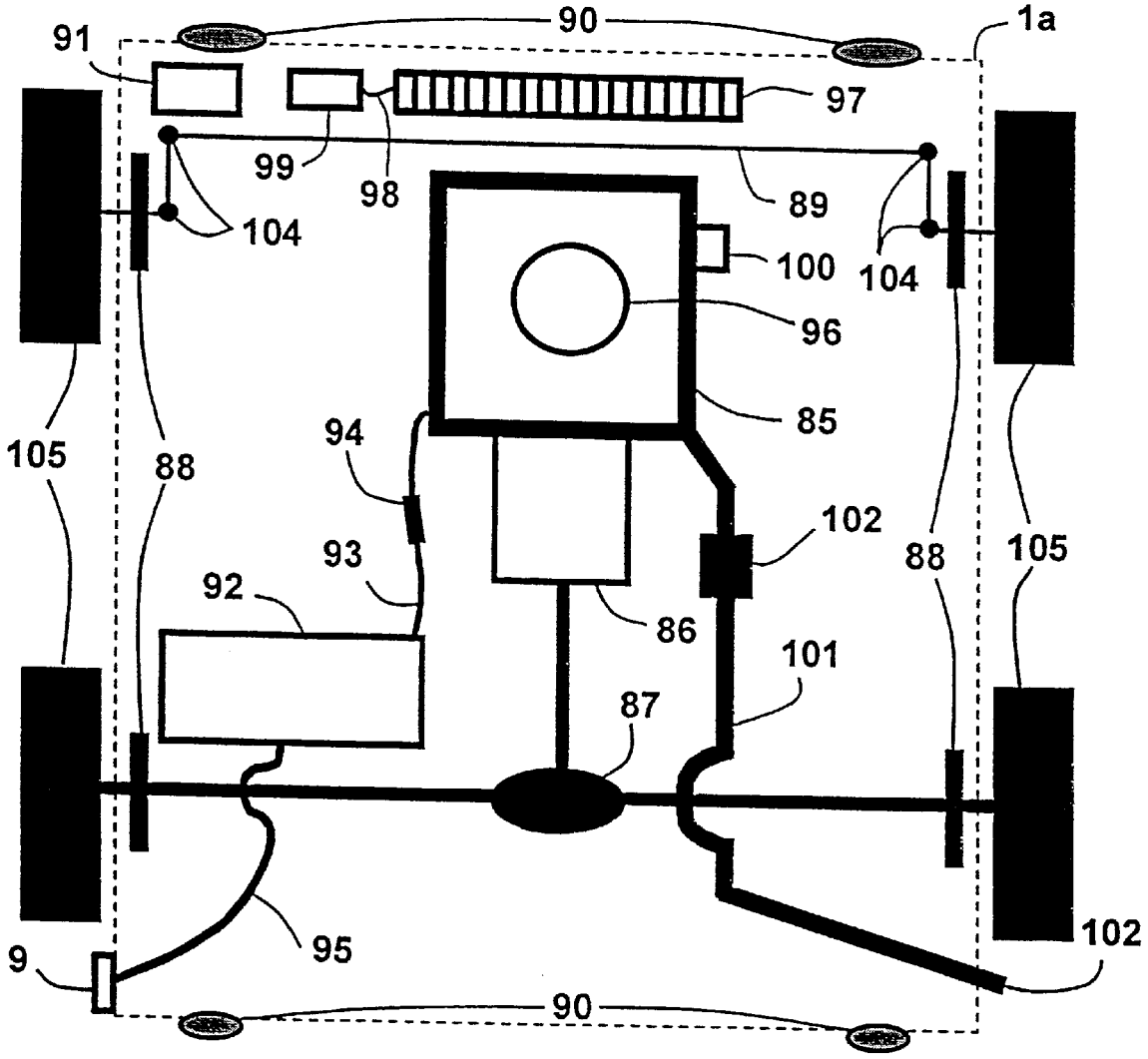
FIGS. 5*a* and 5*b* are schematic illustrations of exemplary apparatus such as a vehicle and an industrial equipment showing various components and sub-systems that can be maintained or inspected utilizing the systems of this invention.
Figure 5B:
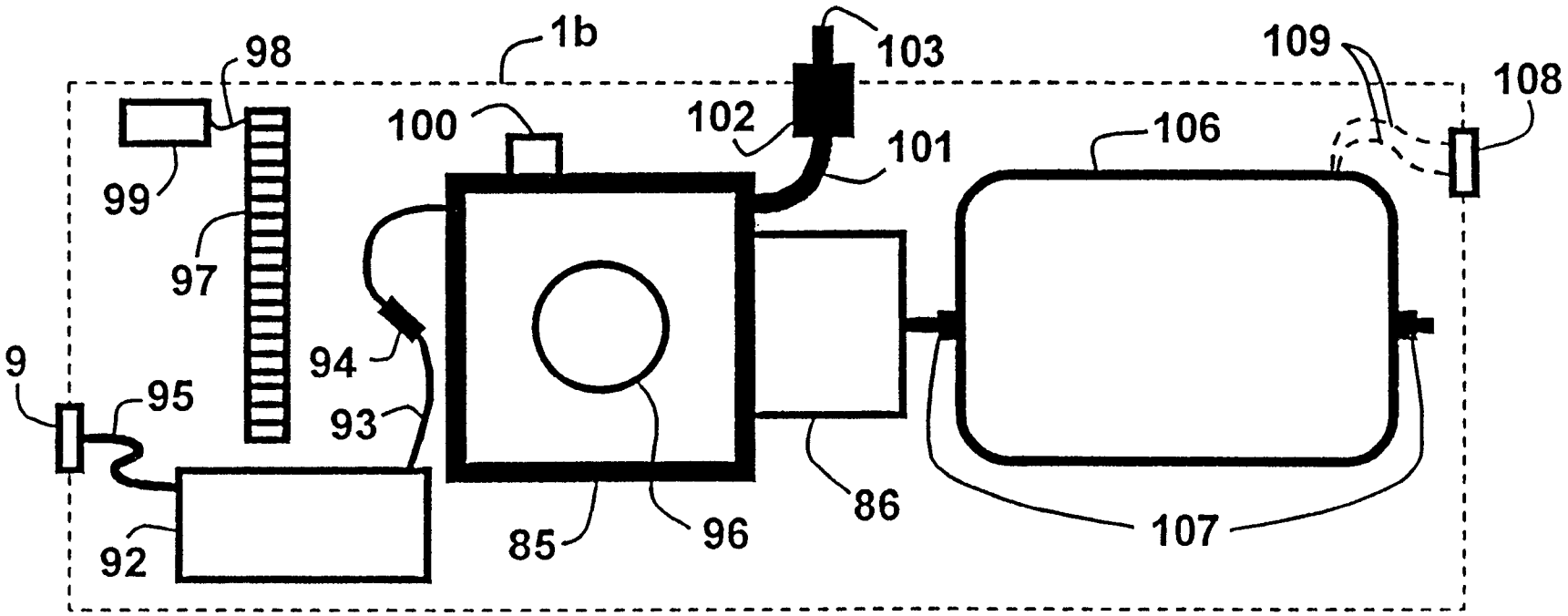

For a better understanding of some of the apparatus components and sub-systems that may be diagnosed and/or maintained by the systems of the present invention, reference is made to FIGS. 5*a* and 5*b* which show schematics of exemplary apparatus such as transportation vehicle 1*a* and industrial equipment 1*b*. The transportation vehicle 1*a* schematically shown in FIG. 5*a* may be an on-road or off-road vehicle powered by engine 85, transmission 86 and differential 87. Vehicle 1*a* has brakes 88 for slowing and stopping, steering assembly 89 for directional control, lighting 90 for illumination and for conveying information to other vehicle operators about vehicle slowing or directional changes, and reservoir 91 that holds cleaning fluid for the vehicle's windshield (not shown). Engine 85 requires a fuel that is communicated from fuel tank 92 through fuel line 93, which contains fuel-filter 94. Fuel tank 92 is intermittently replenished, as needed, with a nozzle from a fuel service location (not shown) that mates with port 9. Fuel is communicated from port 9 to fuel tank 92 by conduit 95.

Air enters engine 85 through air filter 96. Engine 85 is cooled during operation by a coolant that circulates through the engine and radiator 97. Radiator 97 communicates via conduit 98 with overflow reservoir 99 to allow for the thermal expansion and contraction of coolant during the intermittent operation of vehicle 1*a*. An engine oil is used to lubricate the engine 85 during operation. Filter 100 filters the oil during engine operation. Exhaust system 101 communicates emissions from engine 85 through emissions control device 102 to outlet 103 where the controlled emissions are exhausted to the atmosphere. Steering assembly 89 and other chassis components (not shown) have bushings or joints 104 at various attachment points that require replenishment of grease for proper performance and to maximize service life.

Depending on the type and service of vehicle 1*a*, fuel tank 92 and windshield cleaner reservoir 91 must be replenished on an as-needed basis to maintain proper and safe performance. The level of fluids contained in coolant overflow reservoir 99, engine 85, transmission 86 and differential 87 must be checked and maintained on a regular basis. Also total replacement of such fluids is required on a scheduled basis in order to maintain proper performance over a long service life. Tires 105 and brakes 88 must be checked for wear to determine when they need to be replaced, or to identify other vehicle conditions that could lead to safety or performance issues. For example, uneven tire wear indicates failing or misaligned suspension or steering components. Tires 105 must also be checked for pressure, and engine oil filter 100, fuel filter 94 and air filter 96 must be cleaned or replaced on a scheduled basis. Lights 90 must be checked for operation, and engine exhaust from outlet 102 must be checked for proper engine performance and environmental regulatory compliance. The exterior of vehicle 1*a* should be cleaned and coated/waxed to extend vehicle life and improve vehicle performance.

Industrial equipment 1*b* shown in FIG. 5*b* is an electric power generation unit, commonly referred to as a gen-set, that is used for temporary or remote location power. Keeping items common to apparatus 1*a* of FIG. 5*a* numbered the same, industrial equipment 1*b* includes engine 85, transmission 86, fuel tank 92, fuel line 93, fuel filter 94, port 9, filler conduit 95, air filter 96, oil filter 100, radiator 97 with conduit 98 to coolant overflow reservoir 99, exhaust system 101 with emissions control device 102 and outlet 103. Industrial equipment 1*b* also includes electric generator 106 with bushings 107 that, when operating, provides electric power to outlet 108 through wires 109.

Fuel tank 92 of industrial equipment 1*b* must be replenished on an as-needed basis to maintain proper and safe performance. Bushings 107 require replenishment with grease for proper performance and to maximize service life. The levels of fluids contained in coolant overflow reservoir 99, engine 85 and transmission 86 must be checked and maintained on a regular basis. Also total replacement is conventionally required on a scheduled basis in order to maintain proper performance over a long service life. Engine exhaust from outlet 103 can be checked for proper engine performance and, if required, for environmental regulatory compliance. The exterior of equipment 1*b* can be cleaned or coated to protect from environmental degradation.

Note that while FIG. 5*b* shows a gen-set as an example of industrial apparatus, a remote or temporary internal-combustion-engine powered pump that might be used to irrigate agricultural fields, or a remote or temporary air compressor or hydraulic fluid-power supply that is used in construction or other applications could also have been shown with the fluids listed for FIG. 5*b* and other fluids that require maintenance. Further, the gen-set of FIG. 5*b* could be a sub-system of a larger industrial apparatus that uses the gen-set to provide power. For example, the gen-set could be part temporary or remote mining equipment. The larger industrial apparatus could have fluids in addition to those of the gen-set that require maintenance.

Figure 6:
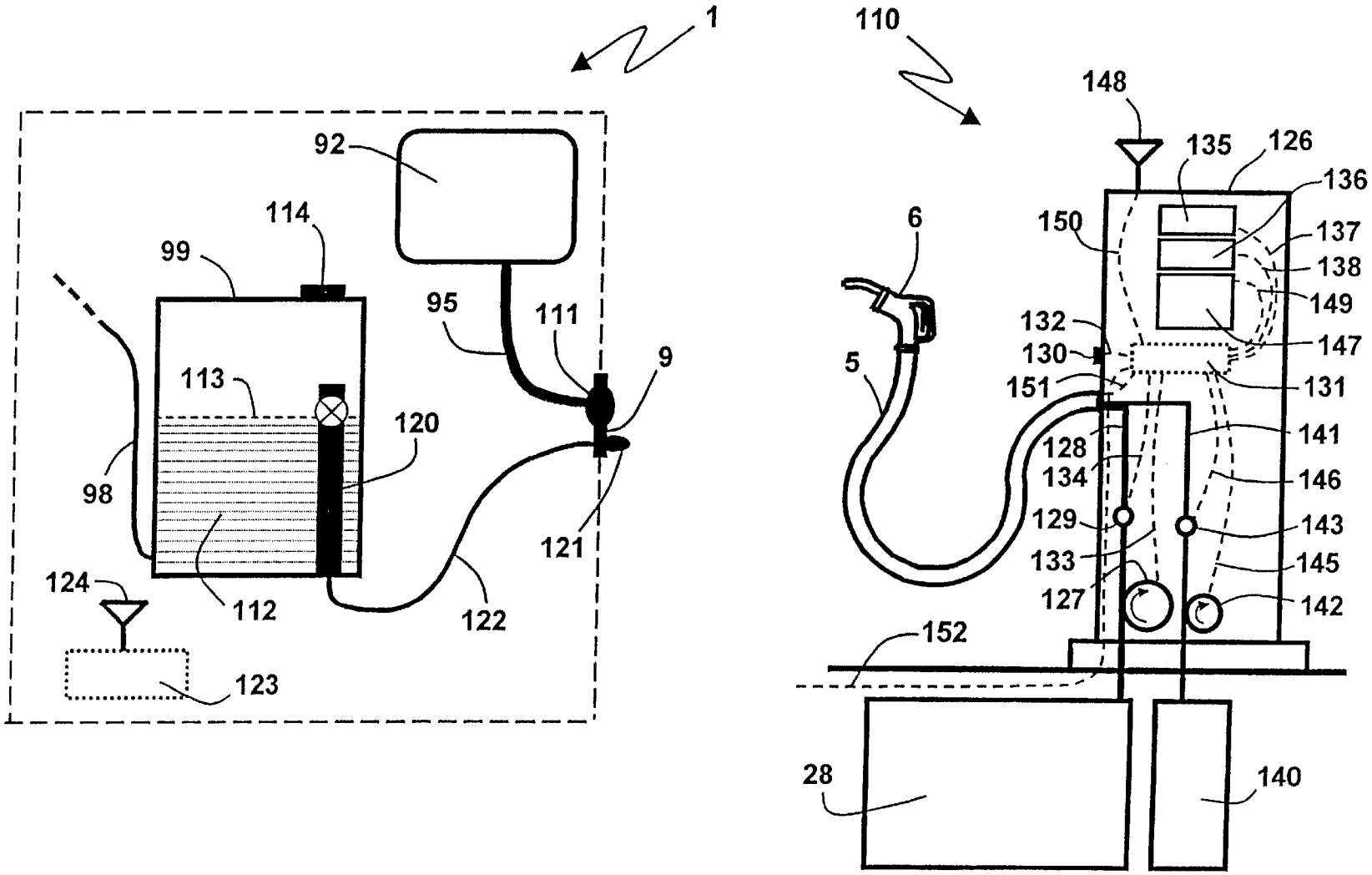
FIG. 6 is a schematic illustration of another invention embodiment for use in maintaining engine coolant level and diagnosing coolant loss of apparatus during refueling.

FIG. 6 shows an invention embodiment that maintains coolant level in overflow reservoir 99 of apparatus 1 during refueling at fuel service location 110. Apparatus 1 has a conventional fuel tank 92 with conduit 95 that communicates fuel from inlet 111 at port 9. The coolant overflow reservoir 99 with coolant 112 communicates with the apparatus' radiator (not shown) through conduit 98. The level of coolant 112 in reservoir 99 varies dependent on coolant temperature in the apparatus engine and radiator (not shown). Under general operating conditions, when apparatus 1 and fuel service location 110 are brought together, the coolant level should be at or above level 113. In a conventional apparatus the level of coolant 112 is checked either by an external visual observation, if reservoir 99 is translucent, or by opening cap 114 and looking inside. When the level of coolant 112 is below level 113, cap 114 is removed from reservoir 99 and an appropriate volume of fresh coolant is added. In the FIG. 6 invention embodiment, an on-apparatus one-way valve assembly 120 communicates with connector inlet 121 through conduit 122. Also, an electronic module 123 with antenna 124 for radio frequency identification (RFID) of apparatus 1 is provided.

One-way valve assembly 120 allows fluid to flow through conduit 122 into reservoir 99 only if the level of fluid 112 is below level 113, but does not allow the flow of fluid out of reservoir 99 through the valve assembly. Inlet 121, which is positioned at port 9, is normally closed, preventing fluid flow, unless mated with an appropriate connector.

Fuel service location 110 includes dispenser 126 with conventional fuel reservoir 28 and pump 127 to pump fuel from fuel reservoir 28 through conduit 128 and hose 5 to nozzle 6. Meter 129 measures the volume of fuel flowing through conduit 128. Dispenser 126 has "on/off" switch 130 and controller 131 that communicates with switch 130 through wire 132. When switch 130 is turned "on", controller 131 powers pump 127 through wire 133 and monitors meter 129 through wire 134, such that when the valve (18 in FIG. 2) in nozzle 6 is opened, fuel flows from the nozzle, and the volume of fuel flow is measured.

Dispenser 126 has displays 135 and 136 communicating by wires 137 and 138 respectively with controller 131, such that as fuel is pumped from reservoir 28, the volume of fuel pumped may, for example, be shown on display 135 and the cost of fuel shown on display 136. With a conventional dispenser, nozzle 6 is mated with fuel inlet 111 on apparatus 1, switch 130 is turned "on", and lever (19 in FIG. 2) on nozzle 6 is controlled by the operator or a maintenance technician at fuel service location 110 to deliver a desired volume or price amount of fuel.

In the FIG. 6 invention embodiment, fuel service location 110 includes a coolant reservoir 140 and conduit 141 that runs from reservoir 140 through hose 5 to a connector at nozzle 6 (not shown in FIG. 6 but which may be similar to any of the connectors 22, 24, 26 shown in FIG. 2) that mates with on-apparatus connector inlet 121 when nozzle 6 is mated with port 9 on apparatus 1. Conduit 141 includes pump 142 to pump coolant from reservoir 140, and meter 143 to measure the volume of fluid flowing through conduit 141. Controller 131 powers pump 142 through wire 145 and monitors meter 143 through wire 146. In this embodiment, dispenser 126 includes a printer 147 and radio frequency transmit/receive antenna 148.

Controller 131 communicates with printer 147 through wire 149 and with antenna 148 through wire 150. Controller 131 has a communication conduit 151 that runs through hose 5 to a connector (not shown) at nozzle 6 that can be used instead of the radio frequency means 148 to communicate with the apparatus and/or to confirm when nozzle 6 is properly mated with port 9 on apparatus 1 and another communications conduit 152 for communicating information between the controller and a location remote from fuel service location 110. Some current dispensers already have RFID receivers, printers and communication conduits to outside sources for credit card and fleet billing purposes. Hence, this invention can make use of those existing devices.

In operation, when switch 130 of this embodiment is turned "on", both fuel pump 127 and coolant pump 142 are powered. Because of the normally closed connector in nozzle 6, and valve assembly 120 in overflow coolant reservoir 99 in apparatus 1, coolant only flows through conduit 122 when nozzle 6 is properly mated to port 9 on apparatus 1, and coolant 112 is below level 113. If coolant is required to "top-off" reservoir 99, the volume of coolant added is shown in display 135 and the cost of the coolant included in the total maintenance cost in display 136. Coolant addition is rapid such that the addition is completed before refueling is completed.

At the end of refueling, switch 130 is turned "off", and a maintenance information report is printed that, for example, can document the amount of fuel and coolant added to apparatus 1. Maintenance information reports are sent to outside organizations that are programmed into controller 131 or that are identified by the information communicated by electronic module 123 of apparatus 1. Also if on-apparatus electronic module 123 has maintenance records storage capability, controller 131 communicates a maintenance information record to electronic module 123.

In general, a report showing the addition of coolant, especially a significant volume of coolant, should be cause for concern. Preferably, controller 131 has access to maintenance information records of apparatus 1 either through stored records on electronic module 123 or records accessible using the ID of apparatus 1 and communication conduit 152. Using maintenance records, if apparatus 1 has a history of coolant additions, controller 131 can diagnose a coolant leak, and, as part of the maintenance information, can print a warning on the operator's or service technician's report that a coolant leak is likely. Also, if desired, controller 131 can issue a maintenance information report that schedules repair at an apparatus repair facility.

Although not shown, dispenser 126 can include a signaling device, for example light or an alarm that is powered "on" if controller 131 diagnoses that a coolant leak is possible in apparatus 1. The warning signal, which could remain on for a predetermined period of time or until the next time that dispenser 126 is turned "on", could provide another means of alerting the apparatus operator or service technician of a possible problem.

Figure 7:
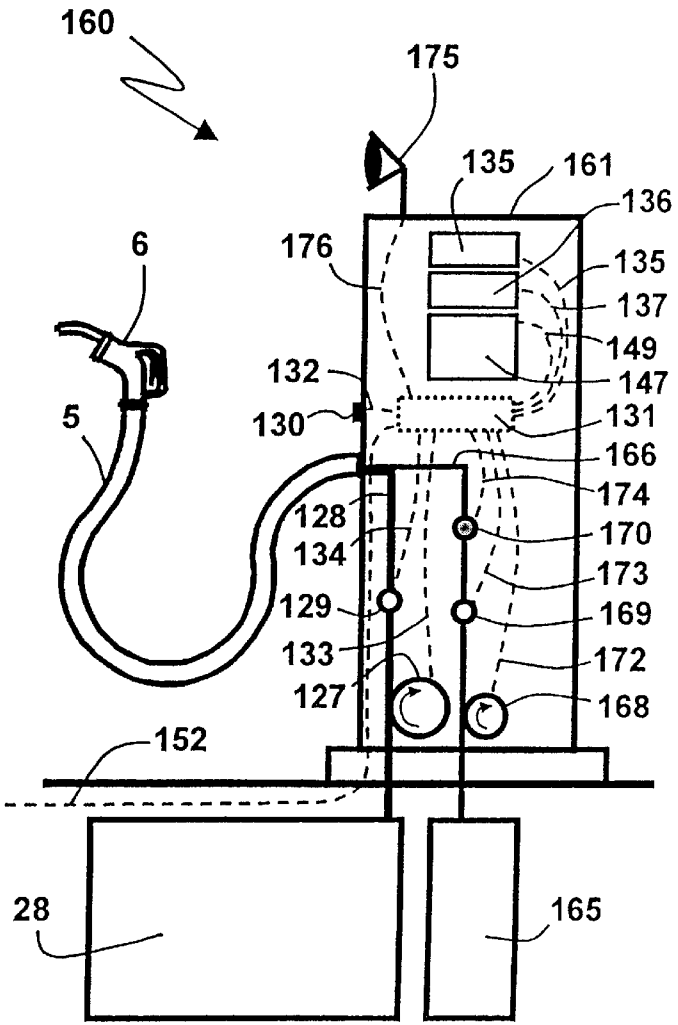
FIG. 7 is a schematic illustration of another invention embodiment for use in diagnosing and maintaining apparatus chassis lubrication based on volume of fuel added to the apparatus during refueling.
Figure 7:
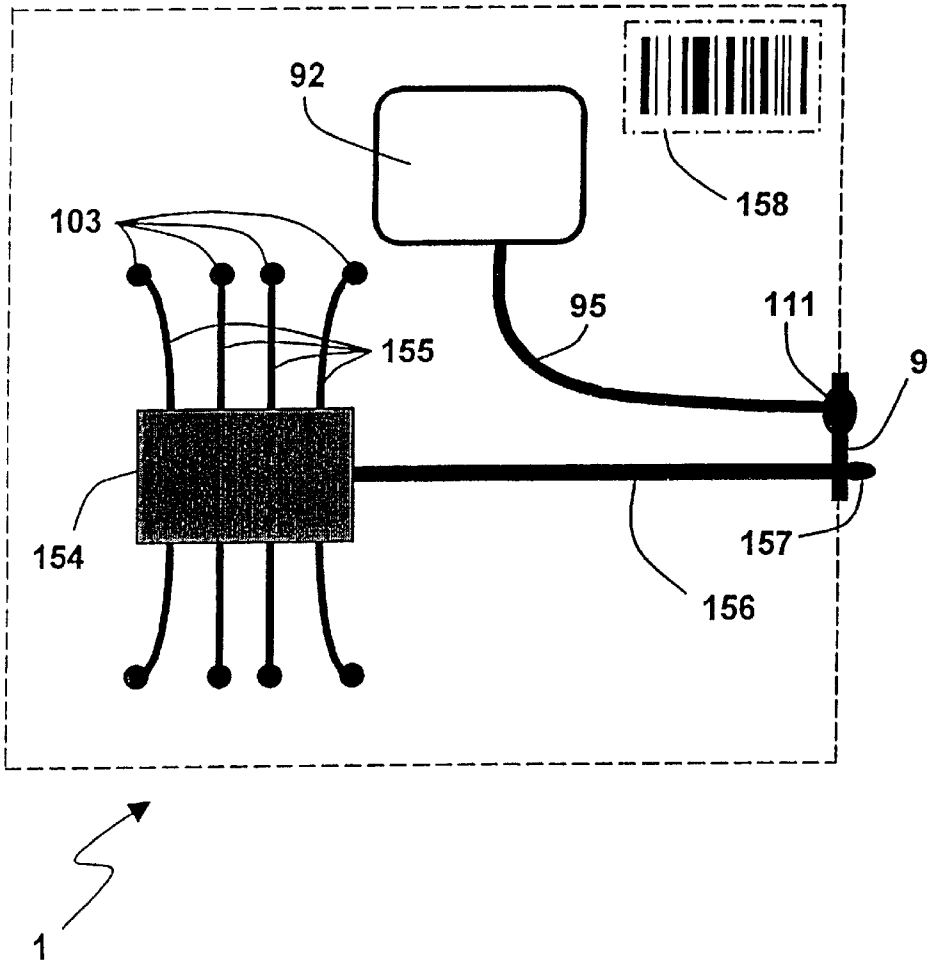

FIG. 7 shows another invention embodiment that maintains proper grease lubrication of the chassis components, bushing or joints (apparatus components) 103 of apparatus 1 during refueling at fuel service location 160. As in the embodiment in FIG. 6, apparatus 1 has conventional fuel tank 92, conduit 95 and inlet 111 at port 9 for refueling as well as chassis components 103 that require regular application of grease for proper operation and long service life. Typically, grease is applied to grease fittings on each individual component at intervals dependent on apparatus type and use. With the present invention embodiment, on-apparatus components are added that include grease distributor or manifold 154, grease conduits 155 and 156, grease inlet and associated connector 157 and passive apparatus information label 158. Inlet 157 is positioned at port 9 and is designed such that inlet 157 is normally closed, preventing grease flow, unless mated with an appropriate connector. Conduit 156 communicates grease from inlet 157 to distributor 154, where grease is distributed to the chassis components 103 through conduits 155 in a designed ratio determined by the grease requirements of the individual components. Information label 158 contains apparatus identification and grease requirements for apparatus 1.

As in the embodiment in FIG. 6, fuel service location 160 of this embodiment has dispenser 161 and conventional fuel reservoir 28, conduit 128, pump 127, meter 129, and other hardware and electronics for refueling apparatus. With the present embodiment of the invention, fuel service location 160 has off-apparatus grease reservoir 165, conduit 166 that runs from reservoir 165 through hose 5 to a connector (not shown in FIG. 7, but which may be similar to any of the connectors 22, 24, 26 shown in FIG. 2) at nozzle 6 that mates with on-apparatus connector 157 when nozzle 6 is mated with the apparatus port 9. Conduit 166 includes pump 168 to pump grease from reservoir 165, meter 169 to measure the volume of grease flowing through conduit 166, and pressure sensor 170 to measure the pressure of grease in conduit 166. Controller 131 powers pump 168 through wire 172, and monitors meter 169 and pressure sensor 170 through wires 173 and 174 respectively. Optical sensor 175, which communicates with controller 131 through wire 176, is conveniently located on fuel service location 160 to read information label 158 on apparatus 1.

In this embodiment, the volume of grease applied to apparatus 1 during refueling is a ratio of the volume of fuel added. Both fuel consumption and grease requirement of apparatus 1 are a function of apparatus use. Hence, for a cost-effective solution, this embodiment assumes a direct relationship between fuel and grease needs of the apparatus. A more sophisticated diagnosis of the grease requirements of apparatus 1 could occur with a greater, and more costly, exchange of information between apparatus 1 and controller 131.

In operation, with the downloaded information of label 158, controller 131 regulates the power applied to grease pump 168 to maintain the desired ratio of fuel volume pumped through conduit 128 as measured by meter 129 and grease volume pumped through conduit 166 as measured by meter 169. Controller 131 also monitors pressure sensor 170 to diagnose if any of the grease lines 155, 156 is broken, resulting in lower than expected pressure, or if there is blockage in any of the system components resulting in higher than expected pressure. As with the embodiment of FIG. 6, at the end of refueling, maintenance information reports are issued, including a warning(s) given if a system failure is diagnosed.

Fluids other than coolant and grease can be replenished, diagnosed and recorded. For example, windshield cleaning fluid can be replenished with components similar to that of FIG. 6. Other embodiments of the invention go beyond fluid replenishment to ease the apparatus maintenance burden. For example, fluid replacement to maintain fluid quality and component rejuvenation can be achieved during refueling.

Figure 8:
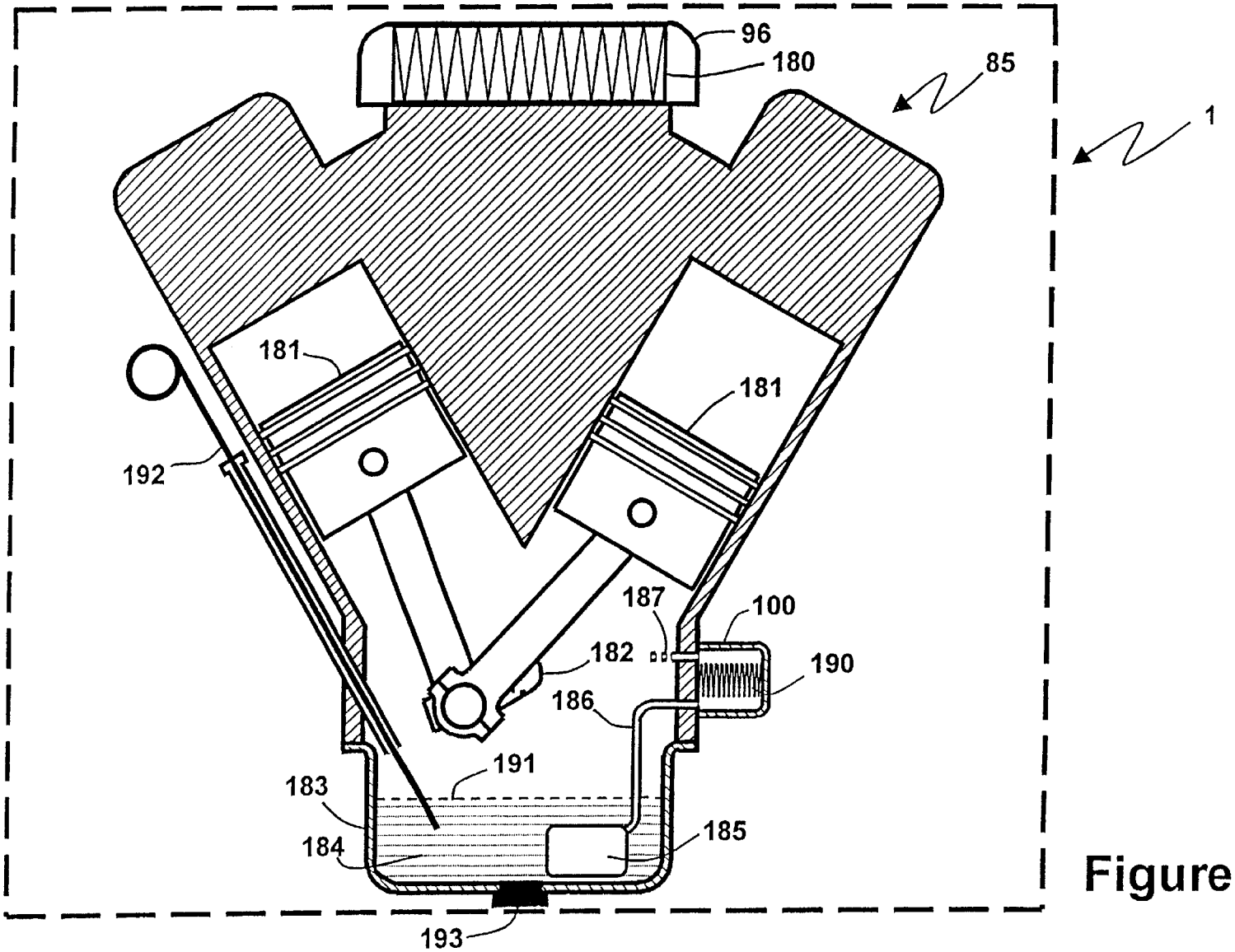
FIG. 8 is a schematic section of an internal combustion engine.

FIG. 8 is a sectional drawing of the internal combustion engine 85 in apparatus 1. Engine 85 has air filter 96 with filter element 180 which removes undesired debris from ambient air to provide clean air for fuel combustion. Pistons 181 and drive crankshaft 182 and other engine components (not shown) require a fluid lubricant to reduce friction and wear during normal operation. Engine 85 includes oil reservoir 183 containing engine oil 184 and oil pump 185.

During engine operation, pump 185 pumps oil 184 from oil reservoir 183, through conduit 186, replaceable oil filter 100 and conduit 187, ultimately applying oil 184 to lubricate the moving components including pistons 181 and crankshaft 182. Oil filter 100 has filter element 190, which removes undesired debris as the oil 184 passes through the filter. Oil reservoir 183 is shown filled with oil 184 to the engine manufacturer's recommended level 191. Dipstick 192 is used to determine the level of oil 184 in oil reservoir 183. Drain plug 193 threads into oil reservoir 183 allowing oil 184 to be drained from engine 85. Near the top of engine 85 is a port (not shown) that allows oil 184 to be added to the engine.

During normal use of apparatus 1, the level of oil 184 is periodically checked using dipstick 192, and, if the oil is not at recommended level 191, a volume of oil is added to reservoir 183 to achieve the recommended oil level. At intervals determined either by the engine manufacturer or the service practices of the apparatus owner, used oil 184 is conventionally removed from engine 85 by removing drain plug 193, and fresh oil is added to the engine to maintain the quality and level of the oil 184 in oil reservoir 183. During these oil changes, oil filter 100 is replaced with a clean filter. Also air filter element 180 may be checked to determine if replacement is needed.

Figure 9:
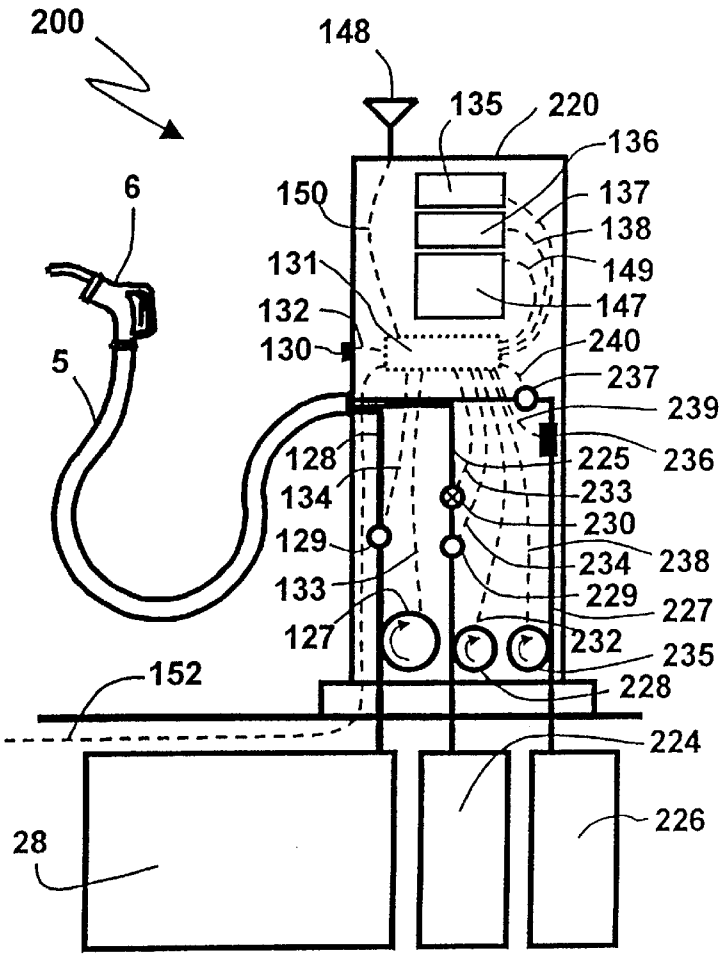
FIG. 9 is a schematic illustration of another invention embodiment for use in diagnosing and maintaining the quality and level of engine oil during refueling.
Figure 9:
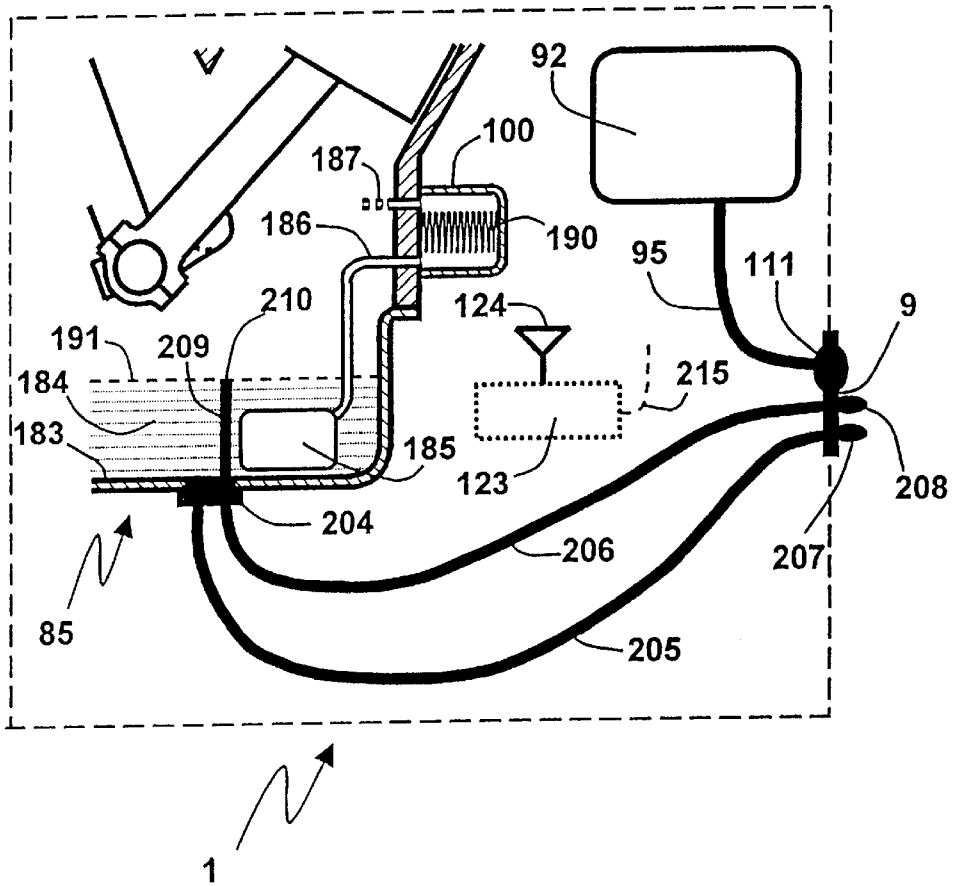

FIG. 9 shows an invention embodiment that maintains level and quality of the engine oil of apparatus 1 during refueling at fuel service location 200. As in the embodiments in FIGS. 6 and 7, apparatus 1 has conventional fuel tank 92, conduit 95 and inlet 111 at port 9 for refueling and has conventional engine 85 shown in greater detail in FIG. 8. With the present invention embodiment, on-apparatus components are added that include oil reservoir fitting 204, conduits 205 and 206, inlet and associated connector 207 and outlet and associated connector 208, overflow 209 and electronic module 123. Conduit 205 communicates fluids between inlet 207 and oil reservoir 183 through fitting 204, and conduit 206 communicates fluid between inlet 210 of overflow 209 and outlet 208.

Inlet 207 and outlet 208 are normally closed, preventing oil flow unless mated to appropriate connectors on nozzle 6. Electronic module 123 has antenna 124 for sending and receiving information and input 215 from sensors (not shown) or other on-apparatus control modules that determine the quality of engine oil 184 or the quantity of engine oil 184 to be replaced to maintain quality. For example, electronic module 123 could receive information from a controller that uses an algorithm of the type disclosed in U.S. Pat. No. 4,847,768, Schwartz et al., July 1989, to determine engine oil quality. Alternatively, electronic module 123 could receive odometer information concerning the number of miles driven since the last oil maintenance to determine the quantity of engine oil 184 to replace. In any case, electronic module 123 can be programmed with engine 85 or apparatus 1 manufacturer's required oil quality or oil replacement specifications for maintaining warranty coverage of the engine.

As in the embodiments shown in FIGS. 6 and 7, fuel service location 200 of this embodiment includes dispenser 220 and conventional fuel reservoir 28, conduit 128, pump 127, meter 129, and other hardware and electronics for refueling apparatus. With the present invention embodiment, fuel service location 200 has added maintenance oil reservoir 224, conduit 225 that runs from reservoir 224 through hose 5 to a connector (not shown but which may be similar to the connectors 22, 24, 26 shown in FIG. 2) at nozzle 6 that mates with on-apparatus connector 207 at port 9. Fuel service location 200 has used oil reservoir 226, conduit 227 that runs from reservoir 226 through hose 5 to a connector (similar to the FIG. 2 connectors) at nozzle 6 that mates with on-apparatus connector 208 at port 9.

Conduit 225 includes pump 228 to pump maintenance oil from reservoir 224, meter 229 to measure the volume of maintenance oil flowing through conduit 225, and valve 230 that normally closes conduit 225. Controller 131 powers pump 228 and valve 230 through wires 232 and 233 respectively, and monitors meter 229 through wire 234. Conduit 227 includes pump 235 to pump used oil to reservoir 226, oil sensing unit 236 that determines oil quality, and meter 237 to measure the volume of oil flowing through conduit 227. Controller 131 powers pump 235 through wire 238 and monitors oil sensing unit 236 and meter 237 through wires 238 and 239 respectively. Fuel service location 200 also has antenna 148, printer 147 and various communication wires that are shown in the embodiment of FIG. 6.

In this embodiment, when dispenser switch 130 is turned "on", pumps 127, 228 and 235 are powered, and controller 131 communicates with on-apparatus electronic module 123 to determine the volume of maintenance engine oil to add to maintain oil quality. Controller 131 powers valve 230 to open until the correct volume of maintenance oil, determined by meter 229, has flowed through conduit 225, on-apparatus inlet 207 and conduit 205 and into oil reservoir 183.

The outlet of conduit 205 at fitting 204 is positioned or directed such that at the designed flow rate, the maintenance oil entering oil reservoir 183 does not quickly mix with the used oil near opening 210 of overflow tube 209. This is relatively easy to accomplish if the engine 85 was operating sufficiently to heat the oil before apparatus 1 and fuel service location 200 are brought together for refueling, since warm oil rises to the top of oil reservoir 183 as the relatively cooler maintenance oil is added near the bottom. Also the oil exchange needed to maintain oil quality should be typically less than 25% of the total volume of oil 184 in engine 85. As the added volume of maintenance oil raises the level of oil 184 in oil reservoir 183 above the manufacturer's recommended level 191, used oil overflows opening 210 of overflow tube 209, and pump 235 pumps the overflowing used oil into used oil reservoir 226.

Controller 131 monitors the flow of used oil through conduit 227 using meter 237, which is designed to measure only the flow of liquid and not gas through the meter. Controller 131 determines the quality of the used oil using oil sensing unit 236. The flow rates of pumps 228 and 235 are such that at the end of refueling apparatus 1, sufficient maintenance engine oil is added and used oil above opening 210 is removed to maintain the quality and level of engine oil 184 in oil reservoir 183. When switch 130 is turned "off", the volume of maintenance oil added is shown on display 135 and the cost of maintenance oil added included in the total cost of fuel and maintenance shown on display 136. As with previous embodiments, maintenance information reports are issued.

A warning is included with maintenance information reports and/or a warning signal is given if either the information sent from on-apparatus electronic module 123 or if output from oil sensing unit 236 shows an abnormal oil condition. For example, detection of engine coolant in the used oil would be an abnormal condition. A warning is issued and/or given if there is a significant difference between the volume of maintenance oil added and the used oil removed, weighted by the volume of fuel added during refueling. A significant difference indicates either excessive oil consumption or oil loss. A warning is issued and/or given if trending from historical maintenance records show an abnormal change or a worsening of the difference between maintenance oil added and used oil removed.

A maintenance information report issued at the end of refueling can be to the manufacturer of engine 85 or apparatus 1 to document type/grade and volume of fuel and oil added and any fluid quality or fluid consumption abnormalities in case warranty repair of engine 85 is ever required.

Figure 10A:
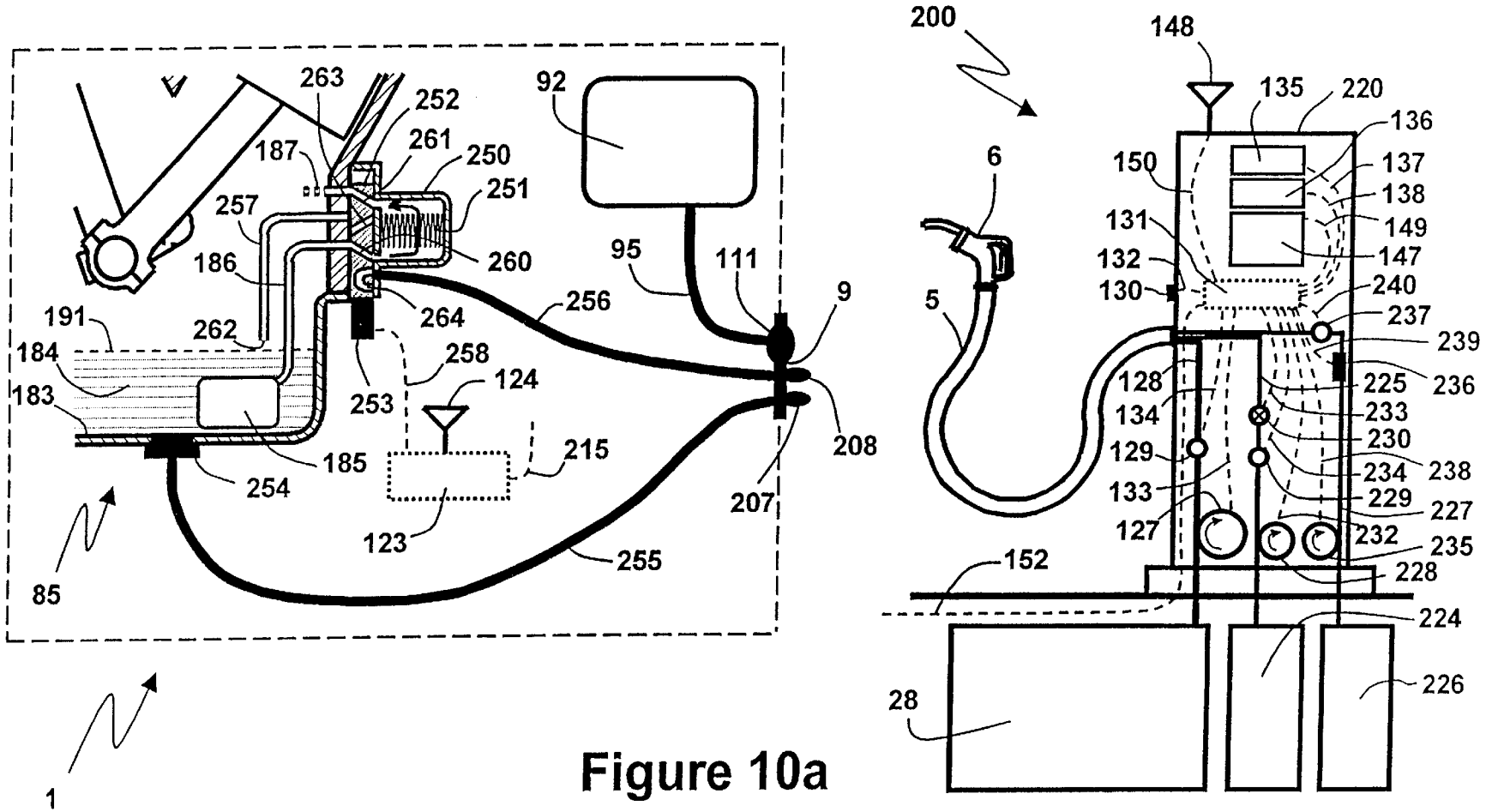
FIGS. 10*a* and 10*b* are schematic illustrations of another invention embodiment for use in backflushing the oil filter of an engine with the engine's own used oil to renew the filter.
Figure 10B:
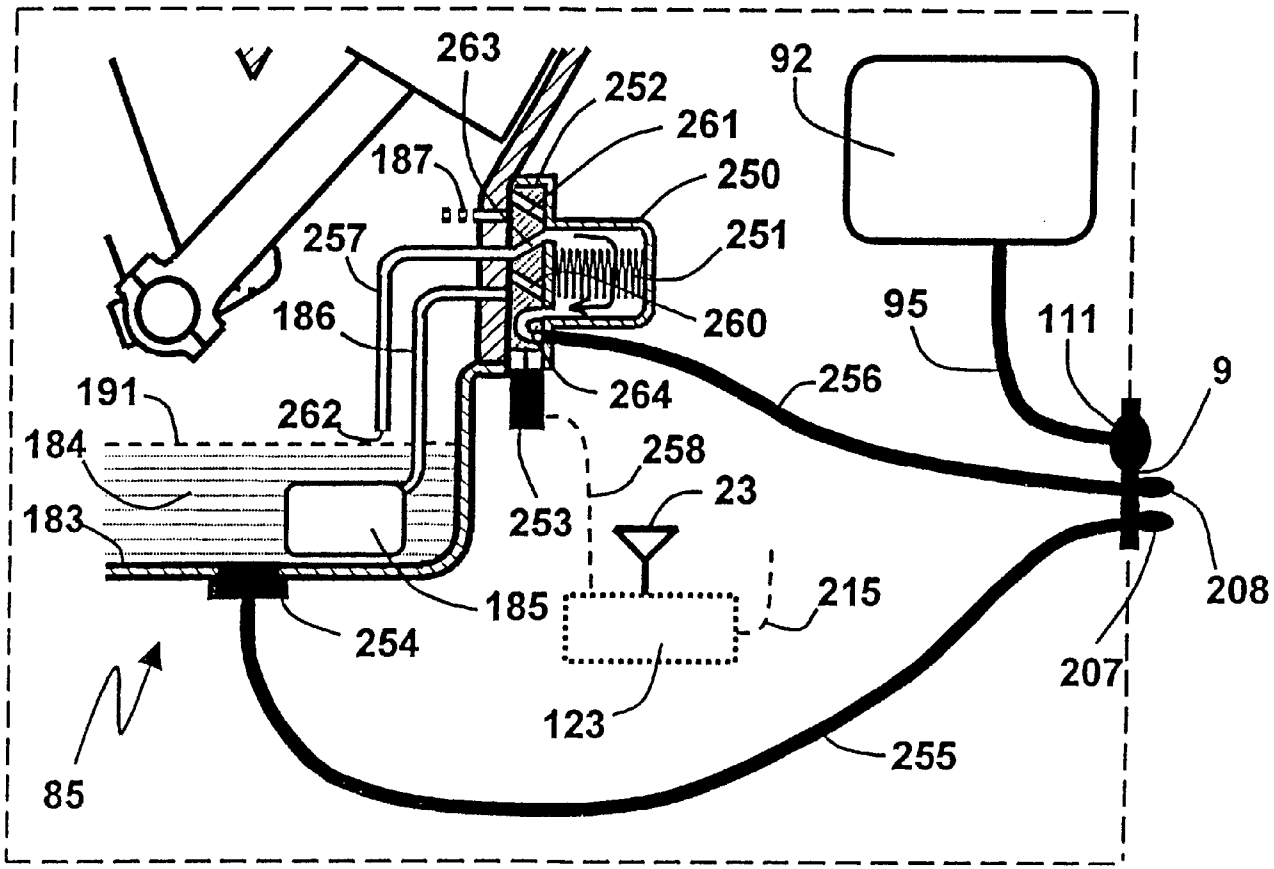

FIGS. 10*a* and 10*b* show an invention embodiment that backflushes the engine oil filter to renew filtering capacity while maintaining the quality and level of engine oil of apparatus 1 during refueling at fuel service location 200. The fuel service location 200 shown in FIG. 10*a* is the same as shown in the embodiment of FIG. 9. As in previous embodiments, apparatus 1 has conventional fuel tank 92, conduit 95 and inlet 111 at port 9 for refueling. With the present invention embodiment, on-apparatus components are added that include replacing the conventional engine oil filter 100 of FIG. 9 with a back flushable oil filter assembly 250 that includes filter element 251, movable valve plate 252 and actuator 253. Added on-apparatus components also include oil reservoir fitting 254, conduits 255, 256, inlet and outlet connectors 207 and 208 at port 9, overflow conduit 257 and electronic module 123. Conduit 255 communicates fluid between inlet connector 207 and oil reservoir 183 through fitting 254 and conduit 256 communicates fluid between the connection on filter assembly 250 and outlet connector 208.

Inlet 207 and outlet 208 have the same design and location as in the embodiment of FIG. 9. Electronic module 123 is similar to that of FIG. 9 with the added output wire 258 to power actuator 253.

In FIG. 10*a* movable valve plate 252 in filter assembly 250 is shown in the position normally held when the apparatus 1 is not being refueled at fuel service location 200, e.g., when engine 85 is normally operating. During such normal engine operation, oil pump 185 urges oil 184 from oil reservoir 183, through conduit 186 and conduit 260 in valve plate 252, through filter element 251 in the direction shown by the arrow, through a second conduit 261 in valve plate 252, through conduit 187, ultimately applying oil 184 to moving components of engine 85. In this normal position, valve plate 252 prevents flow through conduits 257 and 256.

Referring now to FIG. 10*b*, valve plate 252 is shown in position during refueling. When switch 130 (FIG. 10*a*) of fuel service location 200 is turned to "on", electronic engine module 123 communicates to dispenser controller 131 the larger of either the volume of maintenance oil needed to maintain the quality of engine oil 184, or the volume of maintenance oil needed to backflush filter assembly 250. As the information is being communicated, electronic module 123 applies power through wire 258 to actuator 253 to move valve plate 252 to the position shown in FIG. 10*b*. In this position, conduit 256 communicates with conduit 257, such that oil entering opening 262 passes through conduit 257, through a conduit 263 in valve plate 252, through filter element 251 of filter assembly 250 in the direction shown by the arrow, through another conduit 264 in valve plate 252, through conduit 256, and ultimately into used oil reservoir 226 of fuel service location 200 (FIG. 10*a*).

During refueling, maintenance oil is pumped into oil reservoir 183, and used oil is pumped out of oil filter assembly 250. As the oil level in oil reservoir 183 rises above opening 262 of conduit 257, additional used oil backflushes filter element 251. Filter assembly 250 and filter element 251 are designed such that this backflushing renews the capacity of the filter for an appropriate period of engine operation.

Opening 262 of conduit 257 is positioned a fixed distance above the manufacturer's recommended oil level 191 in oil reservoir 183 so that the extra oil 184 in oil reservoir 183 at the end of the maintenance operation equals the oil volume needed to refill filter assembly 250. When refueling is completed and switch 130 (FIG. 10*a*) turned "off", electronic module 123 is instructed to reset, causing power to be removed from actuator 253, which returns valve plate 252 to the position shown in FIG. 10*a*. As with previous embodiments, at the end of refueling, volumes of fluids used and total cost are displayed and maintenance information reports issued. The maintenance information reports can include a warning and/or a warning can be given if an abnormal oil condition is sensed as before.

Note that the power to actuator 253 need not be supplied by on-apparatus electronic module 123 during engine oil maintenance. In another embodiment (not shown) port 9 could include an additional connector with a power conduit communicating between the connector and actuator 253. Hose 5 could include an additional power conduit from dispenser controller 131 to a connector at nozzle 6 that mates with the additional connector at port 9. In this manner, dispenser controller 131 can directly control actuator 253 during refueling.

Figure 11A:
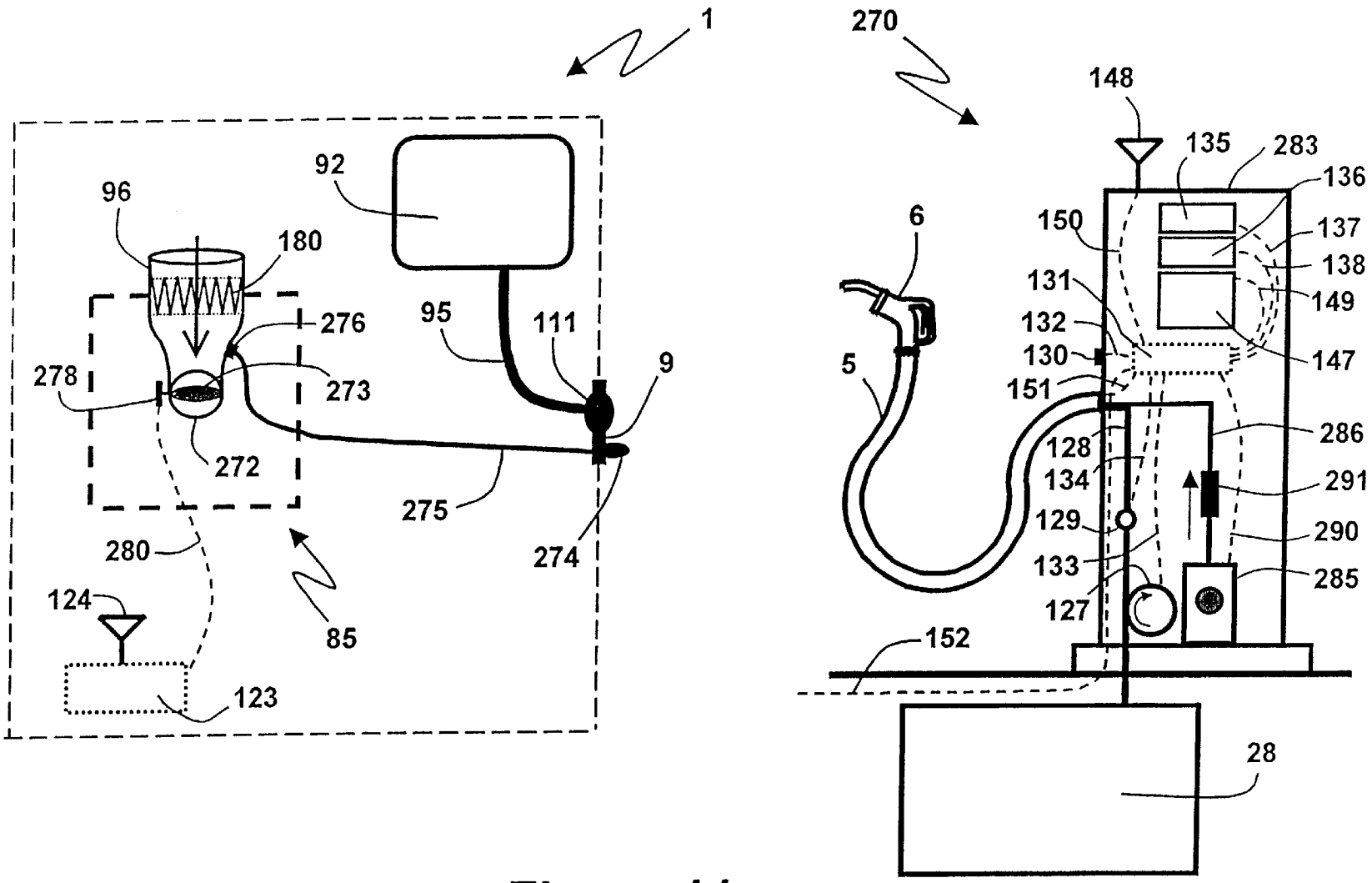
FIGS. 11*a* and 11*b* are schematic illustrations of another invention embodiment that uses clean air to backflush an engine's air filter to renew the filter.
Figure 11B:
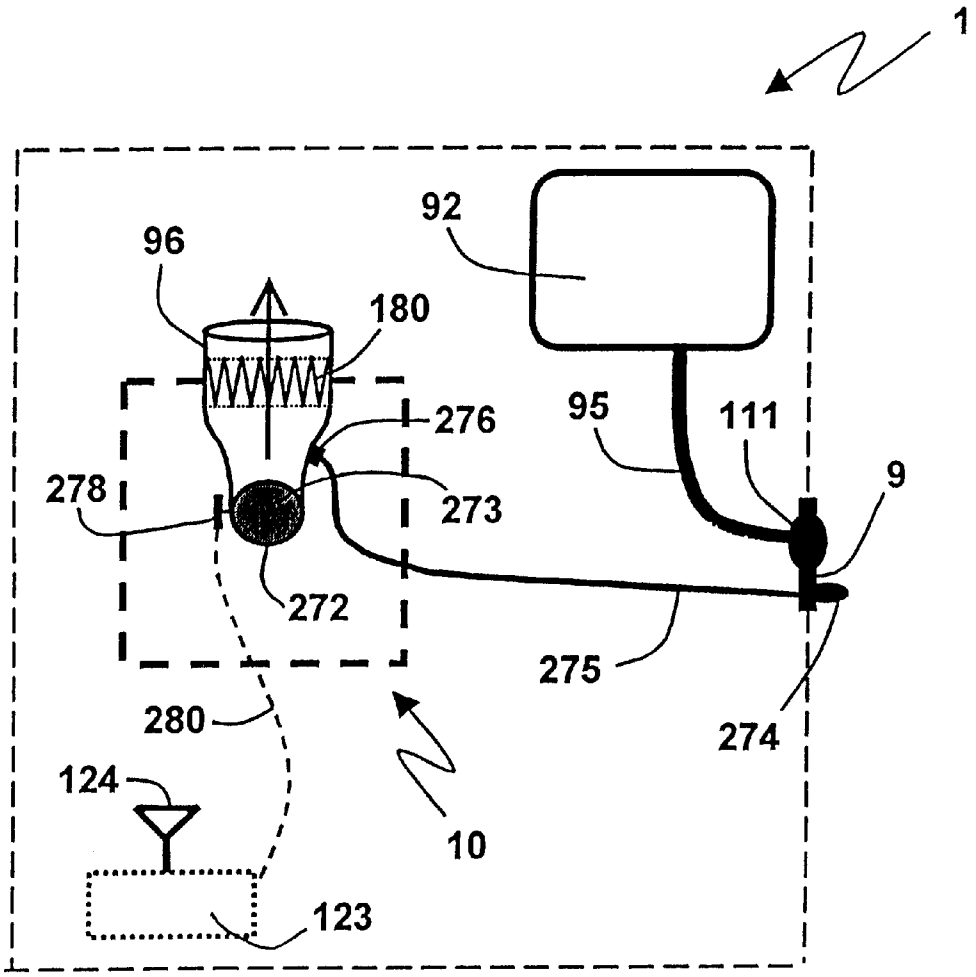

FIGS. 11*a* and 11*b* show an invention embodiment that uses clean air to backflush the engine's air filter element to renew filtering capacity during refueling apparatus 1 at fuel service location 270. As in previous embodiments, apparatus 1 has conventional fuel tank 92, conduit 95 and inlet 111 at port 9 for refueling. Apparatus 1 also has air filter 96 with filter element 180 for directing filtered air into opening 272 of the intake manifold of engine 85. With the present invention embodiment, on-apparatus components are added that include placing valve assembly 273 between the air filter 96 and intake manifold opening 272 and providing communication between inlet connector 274 at port 9 through conduit 275 and fitting 276 on air filter 96 between air filter element 180 and valve assembly 273. Valve assembly 273 includes actuator 278 that normally holds the valve open. Conduit 275 communicates fluid between inlet connector 274 and fitting 276. Inlet connector 274 is normally closed unless mated with an appropriate connector on nozzle 6. Electronic module 123 has output wire 280 to power actuator 278 of valve assembly 273.

FIG. 11*a* shows valve assembly 273 in the position normally held when apparatus 1 is not being refueled at fuel service location 270. During operation of engine 85, air enters air filter 96 and passes through filter element 180 in the direction shown by the arrow. As in previous embodiments of the invention, fuel service location 270 has dispenser 283 and conventional fuel reservoir 28, conduit 128, pump 127, meter 129 and other hardware and electronics for refueling apparatus. With the present invention embodiment, fuel service location 270 has added off-apparatus components in the form of an air compressor 285 and conduit 286 that runs from compressor 285 through hose 5 to a connector (similar to any of the connectors shown in FIG. 2) at nozzle 6 that mates with on-apparatus connector 274 at apparatus port 9. Controller 131 powers compressor 285 through wire 290, and conduit 286 includes air cleaner 291 that removes contaminants from the air as it is pumped through the conduit 286. Fuel service location 270 also includes antenna 148, printer 147 and various communication wires shown in previous invention embodiments.

Referring now further to FIG. 11*b*, during refueling, when switch 130 of fuel service location 270 (FIG. 11*a*) is turned "on", after communicating with dispenser controller 131, electronic module 123 applies power through wire 280 to actuator 278 to move valve assembly 273 to the position shown in FIG. 11*b* blocking opening 272. With switch 130 turned "on", compressor 285 supplies clean air through conduits 286 and 275 to blow air through filter element 180 and out air filter 96 in the direction shown by the arrow. Air filter 96 and filter element 180 are designed such that this backflushing renews the capacity of the filter for an appropriate period of engine operation. When refueling is completed and switch 130 turned "off", electronic module 123 is instructed to reset, causing power to be removed from actuator 278, which returns valve assembly 273 to the position shown in FIG. 11*a*. As with previous embodiments, at the end of refueling, maintenance information reports are issued that show air filter maintenance occurred.

Figure 12:
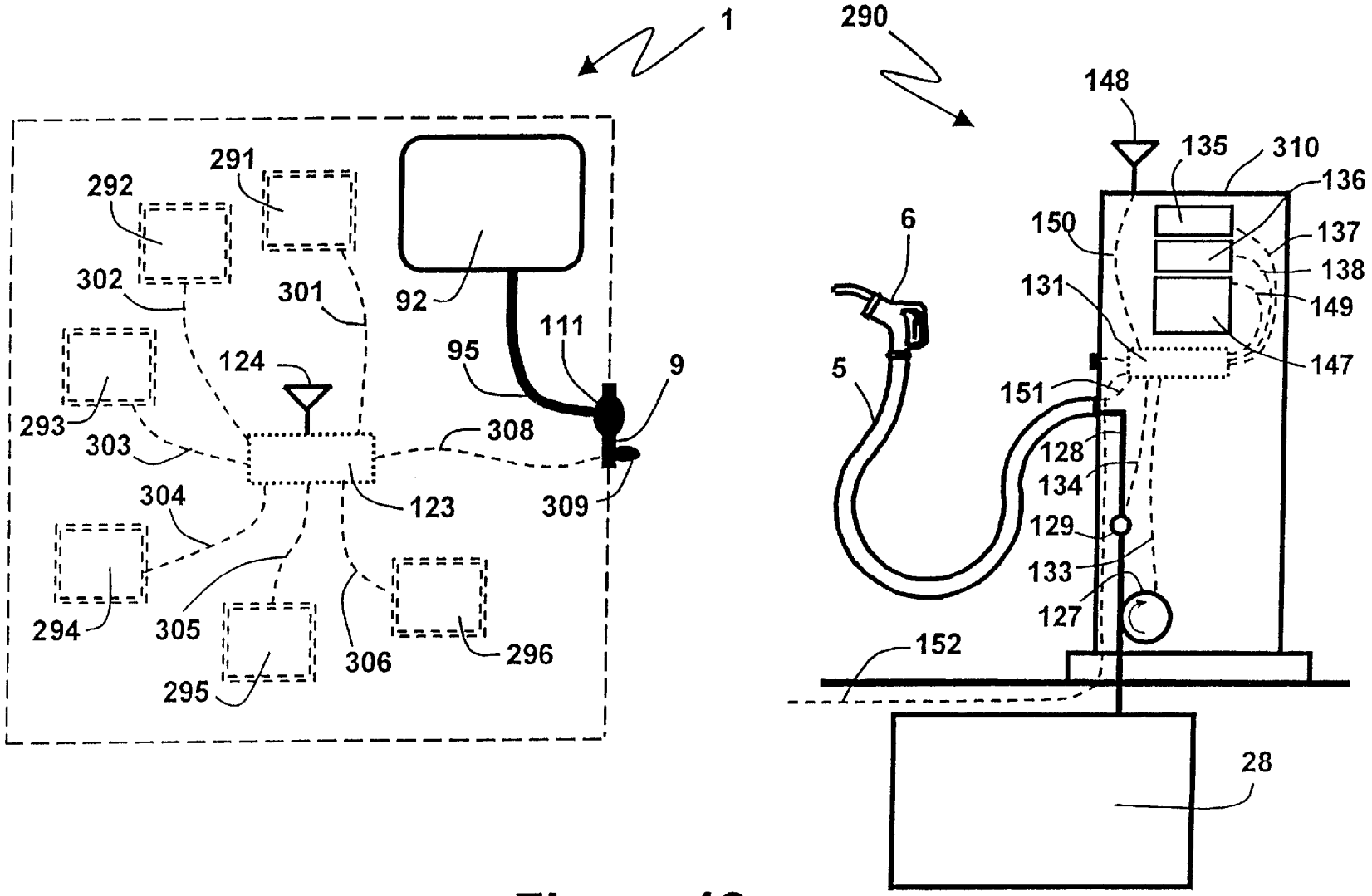
FIG. 12 is a schematic illustration of another invention embodiment that uses sensors on apparatus to monitor apparatus performance and safety condition.

FIG. 12 shows an invention embodiment with sensing units on apparatus 1 to monitor apparatus performance and safety condition and to communicate apparatus condition during refueling at fuel service location 290. As in previous embodiments, apparatus 1 has conventional fuel tank 92, conduit 95 and inlet 111 at apparatus port 9 for refueling. Apparatus 1 also has added on-apparatus components that include electronic module 123 for communicating information from on-apparatus sensing units 291, 292, 293, 294, 295, 296 during refueling. Electronic module 123 uses wires 301, 302, 303, 304, 305 and 306 to communicate with sensing units 291, 292, 293, 294, 295, 296 respectively. Electronic module 123 communicates with fuel service location 290 via antenna 124 and can have wire 308 for communicating information between electronic module 123 and connector 309 at port 9.

Sensing units 291–296 can be specially designed for application with this invention, or can be stand alone units that give the operator real-time performance or safety information and also communicate with electronic module 123. Examples of sensing units are odometer, brake wear indicator, brake fluid sensor, tire pressure sensor, oil level and condition sensors, lighting sensors, filter pressure-drop sensors, emission sensor, fuel economy sensor, and speed/position sensor.

As in previous embodiments of the invention, fuel service location 290 has dispenser 310 and conventional fuel reservoir 28, conduit 128, pump 127, meter 129, and other hardware and electronics for refueling apparatus. With the present invention embodiment, fuel service location 290 has added off-apparatus components of antenna 148, printer 147 and various communication wires shown in previous invention embodiments. During refueling, dispenser controller 131 communicates with on-apparatus electronic module 123 to download safety and performance data that can either be directly documented or analyzed either alone or in conjunction with historical data, and maintenance information report (s) issued which include the performance and safety condition of apparatus 1.

Figure 13:
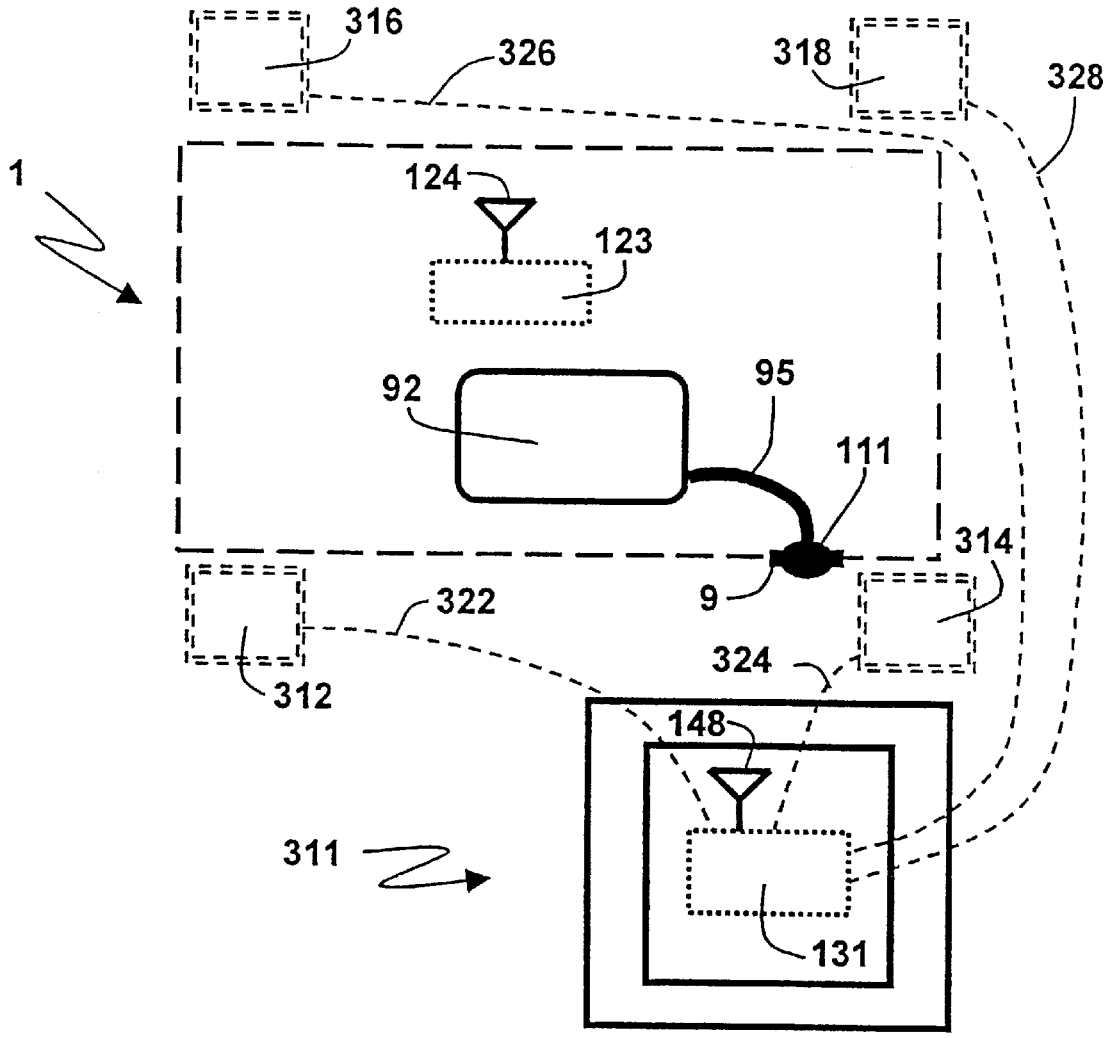
FIG. 13 is a schematic illustration of another invention embodiment that uses sensors at the fuel service location to monitor apparatus performance and safety condition.

FIG. 13 shows an invention embodiment with apparatus 1 at fuel service location 311 that has off-apparatus performance and safety condition sensing units. As in previous embodiments, apparatus 1 has conventional fuel tank 92, conduit 95 and inlet 111 at port 9 for refueling. Apparatus 1 has the added on-apparatus components of electronic module 123 that communicates an apparatus ID when probed. Although not shown, fuel service location 311 includes a dispenser having conventional hardware and electronics for refueling apparatus as in previous invention embodiments. With the present invention embodiment, fuel service location 311 has added off-apparatus components of antenna 148 and various communication hardware and wires shown in previous invention embodiments for communicating with the apparatus operator or service technician and others. Fuel service location 311 also has the added off-apparatus components of sensor units 312, 314, 316, 318 that communicate with controller 131 through wires 322, 324, 326, 328 respectively. Sensor units are designed to inspect apparatus 1 either when apparatus 1 and fuel service location 311 are initially brought together or during refueling.

Examples of sensor units are optical sensors that detect wear patterns for each apparatus tire, tire pressure sensors that work either alone or with components mounted in each tire of apparatus 1 to determine tire pressure, emission sensors that detect engine emissions prior to the engine of apparatus 1 being shut down for refueling at fuel service location 311, and optical sensors to inspect the operation of the apparatus' illumination and safety lighting. In the case where apparatus lighting is sensed, electronic module 123 may include wires (not shown) that can power the various lights of apparatus 1 so that at the command of controller 131, electronic module 123 can power the lights in a sequence that is monitored by the off-apparatus sensors 312–318 to confirm light function. The data from the off-apparatus sensors 312–318 are either directly documented or can be analyzed either alone or in conjunction with historical data, and maintenance information report(s) issued which include the performance and safety condition of apparatus 1.

Figure 14:
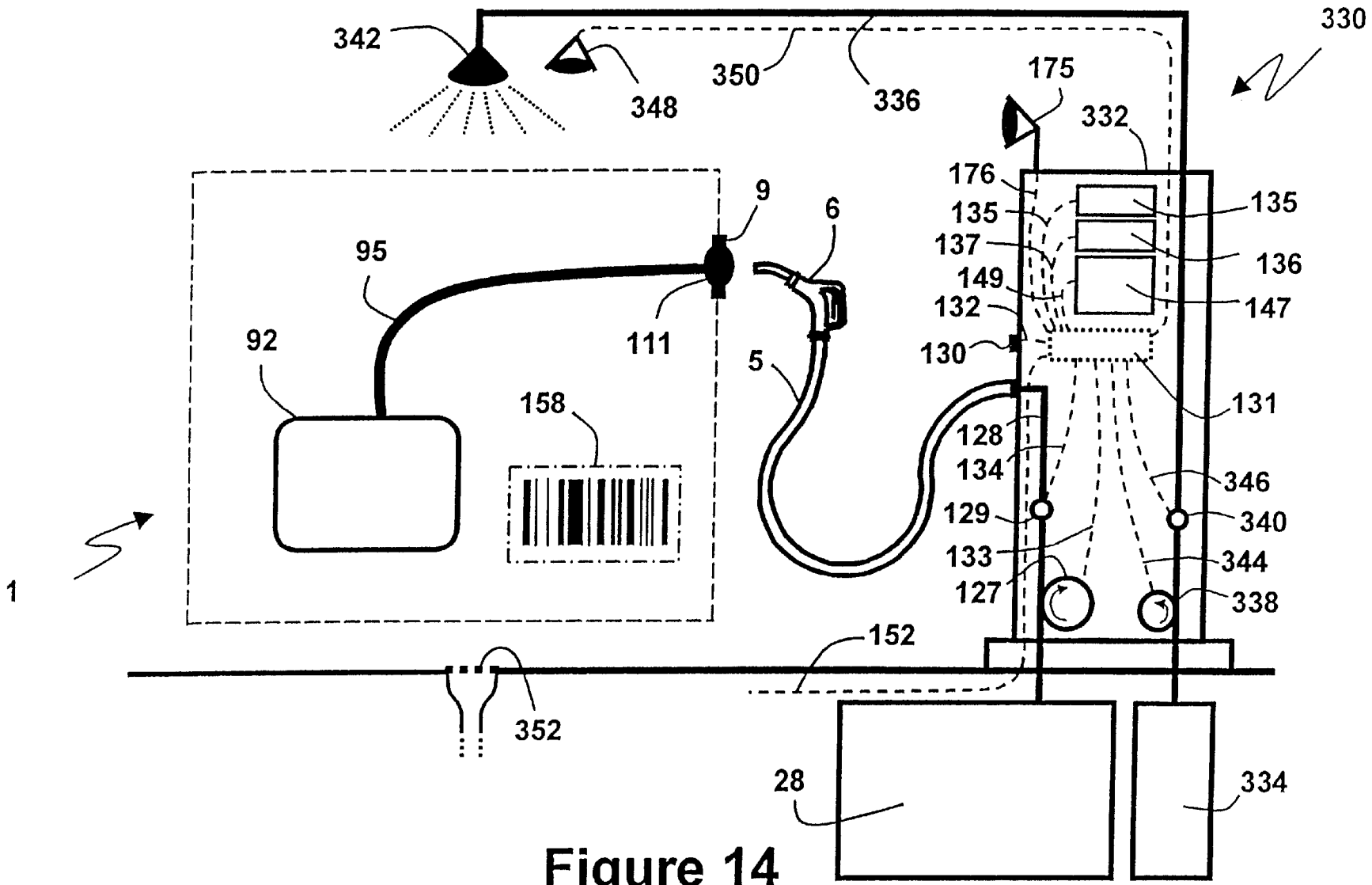
FIG. 14 is a schematic illustration of another invention embodiment for use in maintaining the surface condition of an apparatus.

FIG. 14 shows another example of an off-apparatus sensor, and another means for communicating a non-fuel fluid to maintain an apparatus during refueling. In this invention embodiment, an off-apparatus sensor is used to determine if the exterior surface of the apparatus requires that a cleaning fluid be applied during refueling. Shown is apparatus 1 at fixed fuel service location 330. As in previous embodiments, apparatus 1 also includes information label 158. Fuel service location 330 includes dispenser 332 with conventional fuel reservoir 28, conduit 128, pump 127, meter 129, hose 5, nozzle 6 and other hardware and electronics for refueling apparatus 1 in a conventional manner. In this embodiment, port 9 on apparatus 1 is designed so that when nozzle 6 is inserted into port 9 during refueling, as a liquid is sprayed onto apparatus 1, the liquid is prevented from entering port 9. Dispenser 332 at fuel service location 330 also includes cleaning fluid reservoir 334, conduit 336 with pump 338 and meter 340, that can communicate fluid from cleaning fluid reservoir 334 to spray head 342. Off-apparatus controller 131 at fuel service location 330 powers pump 338 through wire 344, and monitors meter 340 through wire 346. Optical sensor 175, which communicates with controller 131 through wire 176, is conveniently located at fuel service location 330 to read information label 158 on apparatus 1. Optical sensor 348, which communicates with controller 131 through wire 350, is conveniently located at fuel service location 330 to observe the surface condition of apparatus 1. Fuel service location 330 also includes drain 352 that collects excess cleaning fluid from spray head 342 and treats the excess in an environmentally responsible manner.

In operation, with the downloaded information of label 158 and the optical input from sensor 348, controller 131 determines the amount of cleaning fluid from cleaning fluid reservoir 334 that is to be sprayed on the surface of apparatus 1. If cleaning fluid is required, controller 131 powers pump 338 to apply the determined quantity of cleaning fluid to the surface of apparatus 1. Although not shown, controller 131 can also control additional sub-systems required to achieve the desired cleaning of apparatus 1. As in previous embodiments, maintenance fluid volume and cost are displayed, and at the end of refueling maintenance information report(s) issued.

While the embodiment of FIG. 14 is described with a cleaning fluid being applied to apparatus 1, other fluids can also be applied in a similar manner, for example, de-icing fluid, corrosion inhibitors, friction modifiers.

Figure 15:
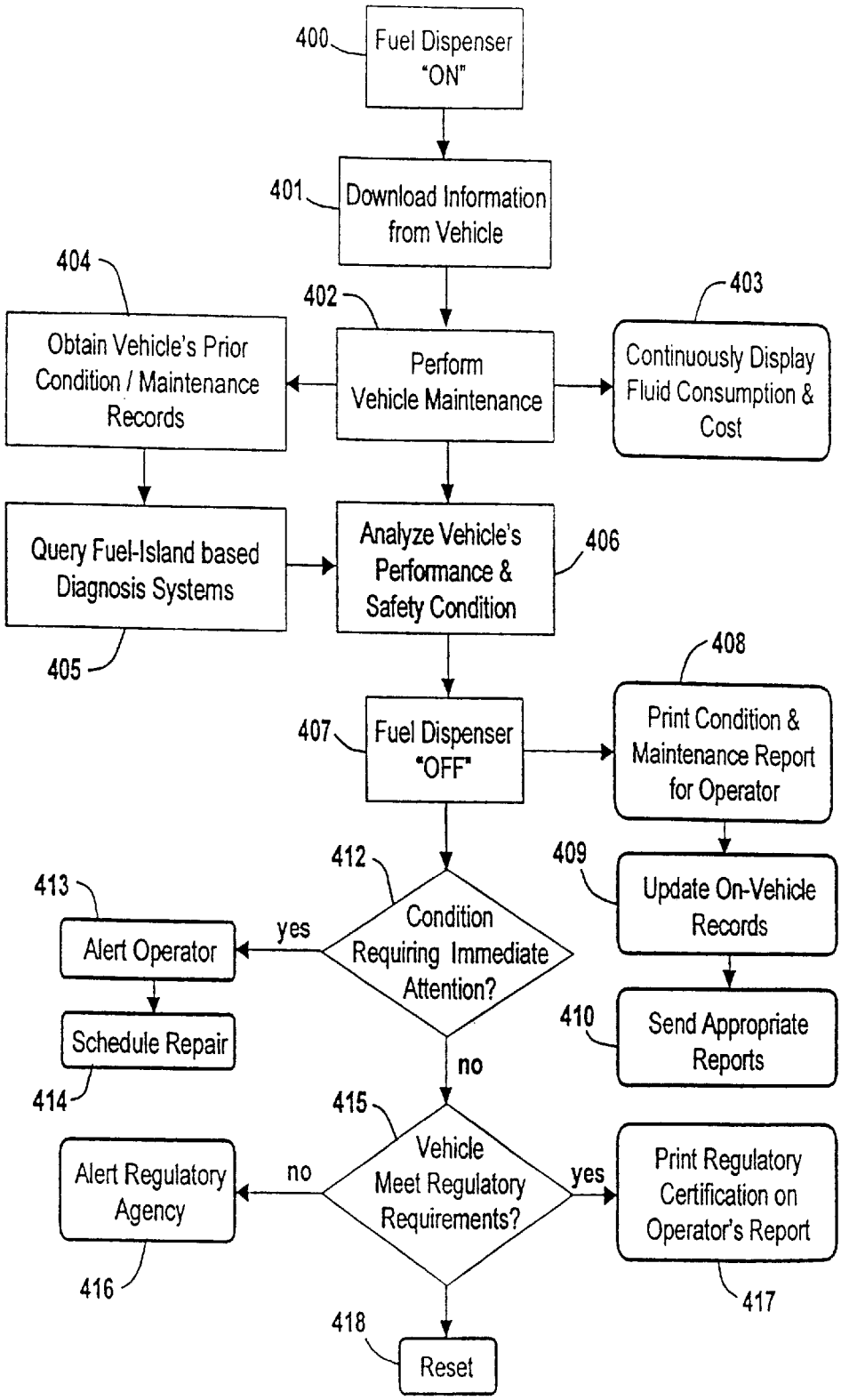
FIG. 15 is a flow chart of the operations at the fuel service location of one embodiment of the invention.

FIG. 15 shows a flow chart of the operations at the fuel service location for one invention embodiment. When the apparatus and fuel service location are brought together, hose(s) from the fuel service location dispenser(s) are connected to the apparatus. The inspection, maintenance and reporting process begins at block 400 when the fuel dispenser is turned "on".

In block 401 information is downloaded that identifies the apparatus. The information may also include outputs from on-apparatus sensing and diagnostic systems, instruction of what maintenance to perform and what fluids to use, for example, fuel and maintenance oil or other fluid type or grade, location where apparatus maintenance information report(s) are to be sent, location where historical maintenance, or other information is kept, or volume of fuel added to the apparatus since the last refueling at a fuel service location with inspection, maintenance and reporting capability of this invention.

The ability of the on-apparatus electronic module to download information about fuel added since the last refueling at a fuel service location with this invention is required if the apparatus must occasionally refuel at a conventional fuel service location and uses volume of fuel added as a variable in a diagnosis and/or maintenance function. The activity of block 401 can download information such as apparatus content, logistics, operator performance and other as a cost-efficient communication means for the apparatus. Downloading can be by radio frequency communication between the apparatus and fuel service location, by optical communication means, or by electrical or acoustic conduit in one or more "hoses" between the apparatus and fuel service location. Downloaded information may include some manually entered information by the operator or maintenance technician, for example, selection of fuel or maintenance oil type or grade, or whether applying a cleaning and/or protective fluid to the surface of the apparatus is desired.

The next block 402 is the maintenance operation. This operation includes replenishing, replacing, renewing or applying maintenance fluids or components based on downloaded information and on the number of mutual inlets and outlets at the fueling port on the apparatus and the nozzle(s) at the fuel service location. Each apparatus that uses the fuel service location nozzle(s) may not have all the on-apparatus components/sub-systems that can be serviced by the fuel service location. For example, not all apparatus will have chassis components that require regular application of grease to maintain proper performance and to achieve long life. The fuel service location, however, may be designed to serve both apparatus that require grease and those that do not. Apparatus not requiring grease will not have an inlet at the apparatus fueling port that mates with the grease connector at the nozzle. Since the nozzle connectors are normally closed unless mated, no grease will be pumped for apparatus without the appropriate connector.

As another example, an apparatus may only use synthetic engine lubricant instead of non-synthetic lubricant. The engine oil inlet at the fuel port may be located in one position if synthetic oil is to be put into the apparatus and in another position if non-synthetic oil is to be put into the apparatus. Similarly, there is the possibility that the apparatus has a connector for a maintenance item that is not serviced by a particular fuel service location. Therefore, only those items for which there are mated connectors on both the apparatus and at the fuel service location can be maintained. In this manner, by downloaded information from the apparatus, the number and configuration of the inlets and outlets on the apparatus, or the number and configuration of inlets and outlets at the nozzle(s), maintenance operations can be tailored to the needs of the individual apparatus, or apparatus owner or operator.

While maintenance is being performed, in block 403 the fuel service location controller monitors the volumes of maintenance fluids being replenished, replaced or otherwise consumed during the maintenance operation and displays the volumes and total cost of the maintenance.

Also as the maintenance is being performed, as shown in block 404 of this embodiment, if historical maintenance records are not included in the information downloaded from the apparatus' electronic module, the fuel service location controller may use an outside communication means to obtain the apparatus' prior maintenance records. If available, these records are obtained either from sources listed in the downloaded information from the apparatus' electronic module, or from a common information database. The historical data is used for trend analysis of apparatus or fluid condition. During the activity of block 404, other information in addition to maintenance information records can be obtained from outside sources that can be later uploaded to the apparatus as part of the reporting process. Such information may include, for example, logistics, scheduled downtime/repair, or personal communications.

As the apparatus is being maintained, in block 405 the fuel service location controller is collecting data from the fuel service location based sensing units. Those units include both those external to the dispenser, for example the sensor units 312–318 shown in FIG. 13, and those internal to the dispenser, for example the fluid condition sensor 236 shown in FIG. 9. For the external sensing units, data can be obtained as the apparatus and fuel service location are brought together or can be obtained while the apparatus is being refueled.

As data from sensors, algorithms and downloaded historical maintenance information is collected, the data are analyzed to determine the apparatus' performance and safety condition. When the maintenance operation is complete, the fuel service location controller, in block 406, has completed the analyses and determined all maintenance items performed.

The dispenser is turned "off" in block 407 as the hose(s) are returned to the dispenser(s). The dispenser controller, in block 408, prints a maintenance information report. The dispenser controller in block 409 uploads maintenance information that updates apparatus records and, if necessary, resets appropriate values used in algorithm to diagnose condition, and resets systems including valves used in the maintenance process or sensing systems that must be initialized each time maintenance is performed. Also in block 409, any information that is other than maintenance information, obtained in block 404 can be uploaded. The fuel service location controller, in block 410, sends appropriate maintenance information reports to locations outside the fuel service location. These maintenance information reports may be used in further analysis to identify performance or safety issues with the apparatus or to optimize apparatus, apparatus sub-system or operator performance. Also in block 410, information downloaded in block 401, that is other than condition and maintenance information, can be communicated to locations outside the fuel service location.

If, when the dispenser is turned "off", the dispenser controller in block 412 has diagnosed a condition that requires immediate attention, the operator or service technician is alerted in block 413 by a printed warning or possibly by other visual or auditory means. Depending on the invention embodiments on the apparatus, the warning could be for something as simple as low pressure in one of the tires or a burned out light that can be easily remedied either at or near the fuel service location. The warning could also be for more serious conditions such as coolant in the engine oil, failed grease lines, or limited life remaining for brakes or tires. For repairs that cannot readily be performed at the fuel service location, the controller, in block 414, can send a maintenance report that automatically schedules a repair at a local repair shop or at a repair shop that is either downloaded from the apparatus' electronic module or chosen by the operator or maintenance technician.

For safety or performance components or systems that are regulated by some agency, in block 415 the fuel service location controller determines if the apparatus meets regulation. If the apparatus does not meet regulation, in block 416 a maintenance information report can be sent to the regulatory agency. If the apparatus meets regulation and certification is required by the apparatus, in block 417 a regulator certification can be printed on the operator's maintenance information report.

At the end of the process, after all maintenance information reports are printed or sent, the fuel service location is reset in block 418, and is prepared for the next apparatus. In this manner, the fuel service location can service a multitude of apparatus.

While particular embodiments of the present invention have been shown and described, it is apparent that changes and modifications may be made therein without departing from the invention in its broadest aspects. For example, the invention embodiments shown in FIGS. 6, 7, 9, 10 and 11 maintain only one fluid and/or one component at a time, the embodiment in FIG. 12 shows only on-apparatus sensing units for diagnostics, and the embodiment in FIG. 13 shows only off-apparatus sensing units for diagnostics. Various combinations of these embodiments can be made, and the tailoring of the invention to fit the needs of the individual apparatus or of the apparatus owner or operator is a feature of the invention.

What is claimed is:

1. A system for automatically maintaining the performance and safety condition of an apparatus during apparatus refueling by communicating at least one non-fuel fluid between the apparatus that requires periodic maintenance of the non-fuel fluid and an off-apparatus maintenance fluid supply located at a fuel service location comprising means responsive to the initiation of the refueling to establish fluid communication between the apparatus and the off-apparatus maintenance fluid supply, and control means for determining a quantity of maintenance fluid to be supplied to the apparatus from the off-apparatus maintenance fluid supply, and for controlling non-fuel fluid communication between the apparatus and the off-apparatus maintenance fluid supply, and wherein the non-fuel fluid is maintained by renewing a contaminant removal device that cleans the non-fuel fluid while the apparatus operates between fueling.

2. The system of claim 1 wherein the contaminant removal apparatus comprises a filter that is renewed by at least one of the following: backflushing the filter with used non-fuel fluid as the used non-fuel fluid is removed from the apparatus during fueling, flushing the filter with a cleaning maintenance fluid that is communicated from a reservoir at the fuel service location.

3. A system for automatically maintaining the performance and safety condition of an apparatus during apparatus refueling by communicating at least one non-fuel fluid between the apparatus that requires periodic maintenance of the non-fuel fluid and an off-apparatus maintenance fluid supply located at a fuel service location comprising means responsive to the initiation of the refueling to establish fluid communication between the apparatus and the off-apparatus maintenance fluid supply, wherein the apparatus includes a port comprising single or a plurality of ports for communicating fluids having one or more connectors communicating with one or more apparatus components that require periodic non-fuel fluid maintenance, and the off-apparatus maintenance fluid supply includes a hose with one or more conduits and a hose nozzle containing one or more connectors oriented for establishing communication between the connectors at the apparatus port and the appropriate maintenance fluids at the maintenance fluid supply, and control means for determining a quantity of maintenance fluid to be supplied to the apparatus from the off-apparatus maintenance fluid supply, and for controlling non-fuel fluid communication between the apparatus and the off-apparatus maintenance fluid supply.

4. The system of claim 3 wherein the apparatus is at least one of the following types that has at least one non-fuel fluid that requires periodic maintenance: vehicle, industrial equipment.

5. The system of claim 3 wherein the fuel service location is fixed and the apparatus is brought to the fuel service location for refueling and maintenance.

6. The system of claim 3 wherein the fuel service location is mobile and can be brought to the apparatus for refueling and maintenance.

7. The system of claim 3 wherein the non-fuel fluid is at least one of the following: liquid, gas, semi-solid, particulate that can be fluidized.

8. The system of claim 3 wherein the non-fuel fluid is at least one of the following: engine oil, gear lubricant, metalworking fluid, hydraulic fluid, coolant, transmission fluid, brake fluid, cleaning fluid, air, nitrogen, oxygen, carbon dioxide, refrigerant, grease, fluidized abrasive, electric charge.

9. The system of claim 3 wherein the non-fuel fluid is maintained by replenishing at least a portion of the non-fuel fluid with the maintenance fluid.

10. The system of claim 9 wherein the maintenance fluid comprises at least one of the following: a fluid that is substantially the same as the non-fuel fluid being replenished, a fluid that is specially formulated as a replenishment fluid for the non-fuel fluid.

11. The system of claim 3 wherein the non-fuel fluid is maintained by renewing the non-fuel fluid with the addition of a maintenance fluid that has at least one additive that improves the fluid performance of the non-fuel fluid.

12. The system of claim 11, wherein the performance additive includes at least one of the following: corrosion inhibitor, viscosity modifier, dispersant, friction modifier, coolant inhibitor, surfactant, detergent, extreme pressure agent.

13. The system of claim 3, wherein the maintenance fluid is applied by spraying.

14. The system of claim 13 wherein the maintenance fluid comprises at least one of the following: cleaner, de-icer, wax, corrosion, inhibitor, friction modifier.

15. The system of claim 3 wherein the control means determines the volume of maintenance fluid to be supplied to the apparatus during refueling based on at least one of the following non-fuel fluid conditions: level, contamination amount, contamination type, viscosity, electrical property, optical property.

16. The system of claim 3 wherein the control means determines the volume of maintenance fluid to be supplied to the apparatus during refueling based on at least one of the following, since the last fluid maintenance during refueling: apparatus use, apparatus condition, a combination of non-fuel fluid condition, apparatus use and apparatus condition.

17. The system of claim 16 wherein apparatus use includes at least one of the following: time of operation, number of operations, distance traveled, fuel use since the last non-fuel fluid maintenance during refueling.

18. The system of claim 16 wherein apparatus condition is based on efficiency of apparatus operation.

19. The system of claim 3 wherein the control means determines the kind, type and grade of maintenance fluid to be used with a particular apparatus.

20. The system of claim 3 wherein the control means further comprises means for identifying a particular apparatus during refueling.

21. The system of claim 3 wherein the control means further comprises means for recording and storing maintenance information for individual apparatus at least at one of the following locations for later retrieval: on the individual apparatus, at the fuel service location, at a location remote from the fuel service location.

22. The system of claim 3 wherein the control means further comprises means for communicating maintenance information for a particular apparatus between the control means and at least one location remote from the control means.

23. The system of claim 22 wherein the control means further comprises means for communicating information other than maintenance information between the apparatus and at least one location remote from the apparatus during refueling.

24. The system of claim 3 wherein the control means is on the apparatus and communicates information needed to control the off-apparatus maintenance fluid supply located at the fuel service location using a communication port on the apparatus.

25. The system of claim 3 wherein the control means is located at the fuel service location and communicates information needed to control the communication of the maintenance fluid to the apparatus.

26. The system of claim 25 wherein the information is communicated using a communication port on the apparatus.

27. The system of claim 25 wherein the control means also controls the fluid communication of fuel from the fuel service location to the apparatus.

28. The system of claim 3 wherein the control means is located in part on the apparatus and in part at the fuel service location with communication means between the two parts.

29. The system of claim 28 wherein the communication means includes a communication port on the apparatus.

30. The system of claim 28 wherein the communication means is radio frequency based.

31. The system of claim 28 wherein the part of the control means at the fuel service location also controls the fluid communication of fuel from the fuel service location to the apparatus.

32. The system of claim 31 further comprising means for communicating information between the apparatus and the fuel service location through the apparatus port.

33. The system of claim 3 wherein the apparatus includes an engine having an engine oil reservoir containing engine oil which is the non-fuel fluid that is maintained during refueling, and an on-apparatus sub-system that includes means for communicating maintenance oil to and used oil from the engine oil reservoir, and the off-apparatus maintenance fluid supply includes a maintenance oil reservoir for providing a supply of maintenance engine oil and a used engine oil reservoir for receiving used engine oil from the apparatus, and the control means controls the level and quality of the engine oil in the engine oil reservoir during refueling.

34. The system of claim 33 wherein the on-apparatus sub-system includes an overflow in the engine oil reservoir in which any excess used engine oil is communicated to the used engine oil reservoir during refueling.

35. The system of claim 34 wherein the on-apparatus sub-system includes a backflushable oil filter assembly, and means for causing the excess used engine oil that is removed from the engine oil reservoir to flow back through the oil filter assembly prior to being communicated to the used engine oil reservoir.

36. The system of claim 35 wherein the means for causing the excess used engine oil to flow back through the oil filter assembly includes an overflow that is positioned a predetermined distance above a manufacturer's recommended engine oil level in the engine oil reservoir such that the added volume of maintenance oil in the engine oil reservoir is equivalent to the volume of engine oil needed to refill the oil filter assembly at the end of oil maintenance.

37. The system of claim 3 wherein the apparatus includes at least one apparatus component requiring lubrication grease which is the non-fuel fluid that is maintained during refueling, and an on-apparatus sub-system that distributes grease supplied to an apparatus port to the apparatus component, and the off-apparatus maintenance fluid supply includes a grease reservoir for supplying grease to the apparatus port during refueling.

38. The system of claim 37 wherein the control means includes means for measuring the pressure of the grease supplied to the apparatus port by the off-apparatus maintenance fluid supply, and if the pressure is higher or lower than expected, the control means includes means for giving a warning of a possible component or system failure.

39. The system of claim 3 wherein the apparatus includes a coolant overflow reservoir containing coolant which is the non-fuel fluid that is maintained during refueling, and an on-apparatus sub-system that includes means for communicating coolant to a one-way valve assembly that only allows coolant flow into the coolant overflow reservoir when the coolant level in the coolant overflow reservoir is low, and the off-apparatus fluid maintenance supply includes a coolant reservoir for supplying coolant to the one-way valve assembly to maintain the coolant level in the coolant overflow reservoir during refueling.

40. The system of claim 3 wherein the apparatus includes an internal combustion engine, and a backflushable air filter assembly for the engine, and means for communicating clean air supplied to the backflushable air filter assembly, and the off-apparatus maintenance fluid supply includes a supply of pressurized clean air to backflush the air filter assembly during refueling.

41. The system of claim 3 further comprising means at the fuel service location for displaying at least one of the following: the volume of maintenance fluid communicated during refueling, the cost of maintenance fluid communicated during refueling.

42. The system of claim 3 further comprising means at the fuel service location for printing a report containing maintenance information at the end of refueling.

43. The system of claim 3 further comprising means at the fuel service location for communicating maintenance information to a location remote from the fuel service location at the end of refueling.

44. The system of claim 3 wherein the control means further comprises means for diagnosing performance and safety condition of an apparatus during refueling.

45. The system of claim 44 further comprising at least one sensor for monitoring apparatus performance and safety condition.

46. The system of claim 45 wherein the sensor is located on the apparatus.

47. The system of claim 45 wherein the sensor comprises at least one of the following: an odometer, brake fluid sensor, fluid level sensor, fluid condition sensor, fluid contaminant sensor, filter pressure-drop sensor, emission sensor, fuel economy sensor, speed/position sensor.

48. The system of claim 45 further comprising on-apparatus means for receiving information from the sensor and communicating such information to the control means which is located off-apparatus.

49. The system of claim 45 further comprising on-apparatus means for storing information sensed by the sensor.

50. The system of claim 45 wherein the sensor is located at the fuel service location and includes at least one of the following: tire pressure sensor, tire wear sensor, lighting sensor, engine emission sensor.

51. The system of claim 44 wherein the control means further comprises means for identifying a particular apparatus during refueling.

52. The system of claim 51 wherein the control means further comprises means for recording and storing apparatus performance and safety condition information at the fuel service location for individual apparatus for later retrieval.

53. The system of claim 51 wherein the control means further comprises means for communicating maintenance information including performance and safety condition of a particular apparatus between the control means and at least one location remote from the control means during refueling.

54. The system of claim 53 wherein the maintenance information includes historical performance and safety condition information about the particular apparatus.

55. The system of claim 53 wherein the maintenance information includes current performance and safety condition information about the particular apparatus.

56. The system of claim 53 wherein the control means further comprises means for communicating information other than maintenance information between the apparatus and at least one location remote from the control means during refueling.

57. The system of claim 44 further comprising on-apparatus means for identifying the kind, type and grade of maintenance fluid to be used with the apparatus.

58. The system of claim 44 wherein the control means further comprises means for determining the volume of maintenance fluid to be supplied to the apparatus during refueling based on diagnosed apparatus performance and safety condition.

59. The system of claim 44 wherein the control means further comprises means for recording and storing maintenance information on the apparatus for later retrieval.

60. The system of claim 44 further comprising means at the fuel service location for printing a report with maintenance information at the end of refueling.

61. The system of claim 44 further comprising means at the fuel service location for displaying a report with maintenance information at the end of refueling.

62. A system for automatically maintaining the performance and safety condition of an apparatus during apparatus refueling at a fuel service location comprising at least one first sub-system on the apparatus for providing fluid communication between an apparatus fluid communication port and an apparatus component that requires periodic maintenance of a non-fuel fluid for proper operation, a second sub-system mounted at an off-apparatus fuel service location for providing a supply of maintenance fluid for a multitude of apparatus equipped with the first sub-system and for communicating the supply of maintenance fluid to the port on the apparatus, and control means, operative in response to the initiation of refueling, for determining the quantity of the maintenance fluid to be supplied by the second sub-system to the first sub-system, and for controlling fluid communication of the maintenance fluid from the second sub-system to the first sub-system during refueling.

63. A system for automatically diagnosing, maintaining and reporting the performance and safety condition of a multitude of apparatus during refueling that require periodic maintenance of at least one non-fuel fluid for proper operation comprising means for sensing apparatus performance and safety condition, means for communicating at least one non-fuel fluid between the apparatus and an off-apparatus maintenance fluid supply at a fuel service location, means for communicating information between the apparatus and the off-apparatus fuel service location, and control means responsive to the initiation of the refueling for: a) determining a quantity of maintenance fluid to be supplied to the apparatus from the off-apparatus maintenance fluid supply, b) controlling both non-fuel fluid communication between the apparatus and the off-apparatus maintenance fluid supply and information communication between the apparatus and the off-apparatus fuel service location during refueling, and c) reporting, at the completion of refueling, apparatus maintenance information.

64. A system for automatically maintaining the performance and safety condition of an apparatus during apparatus refueling by communicating at least one non-fuel fluid between the apparatus that requires periodic maintenance of the non-fuel fluid and an off-apparatus maintenance fluid supply located at a fuel service location comprising means responsive to the initiation of the refueling to establish fluid communication between the apparatus and the off-apparatus maintenance fluid supply, and control means for determining a quantity of maintenance fluid to be supplied to the apparatus from the off-apparatus maintenance fluid supply, and for controlling non-fuel fluid communication between the apparatus and the off-apparatus maintenance fluid supply.

* * * * *